US010323596B2

(12) United States Patent
Miyamoto et al.

(10) Patent No.: US 10,323,596 B2
(45) Date of Patent: Jun. 18, 2019

(54) OIL DILUTION RATE CALCULATION SYSTEM OF INTERNAL COMBUSTION ENGINE

(71) Applicant: TOYOTA JIDOSHA KABUSHIKI KAISHA, Toyota-shi, Aichi-ken (JP)

(72) Inventors: Hiroshi Miyamoto, Susono (JP); Toru Kidokoro, Hadano (JP); Yasushi Iwazaki, Ebina (JP); Kenji Suzuki, Gotemba (JP)

(73) Assignee: Toyota Jidosha Kabushiki Kaisha, Toyota-shi, Aichi (JP)

( * ) Notice: Subject to any disclaimer, the term of this patent is extended or adjusted under 35 U.S.C. 154(b) by 220 days.

(21) Appl. No.: 15/536,938

(22) PCT Filed: Nov. 10, 2015

(86) PCT No.: PCT/JP2015/005607
§ 371 (c)(1),
(2) Date: Jun. 16, 2017

(87) PCT Pub. No.: WO2016/098278
PCT Pub. Date: Jun. 23, 2016

(65) Prior Publication Data

US 2019/0093583 A1 Mar. 28, 2019

(30) Foreign Application Priority Data

Dec. 19, 2014 (JP) ..... 2014-257884

(51) Int. Cl.
*F02D 45/00* (2006.01)
*F02D 41/14* (2006.01)
(Continued)

(52) U.S. Cl.
CPC ..... *F02D 41/1456* (2013.01); *F01M 13/022* (2013.01); *F02D 41/123* (2013.01); *F02D 2250/08* (2013.01); *F02D 2250/11* (2013.01)

(58) Field of Classification Search
CPC ..... F02D 2250/11; F02D 2250/08; F02D 41/2454; F02D 41/123
See application file for complete search history.

(56) References Cited

U.S. PATENT DOCUMENTS

2004/0099252 A1* 5/2004 Nagaishi ..... F02D 35/025 123/480
2004/0182378 A1* 9/2004 Oshimi ..... F02D 41/0025 123/685
(Continued)

FOREIGN PATENT DOCUMENTS

DE 10 2009 046 417 A1 5/2011
JP 2002-243694 8/2002
(Continued)

*Primary Examiner* — Long T Tran
(74) *Attorney, Agent, or Firm* — Finnegan, Henderson, Farabow, Garrett & Dunner, LLP

(57) ABSTRACT

An oil dilution rate calculation system of an internal combustion engine acquires a blowby gas flow ratio showing the ratio of the flow of blowby gas to the flow of gas to the combustion chamber and an output current of the air-fuel ratio sensor during fuel cut control in which the internal combustion engine stops the feed of fuel to the combustion chamber and at a plurality of points of time of different flows of blowby gas passing through the blowby gas passage and flowing to the downstream side of the throttle valve in the intake passage, and calculate an oil dilution rate based on the acquired blowby gas flow ratio and output current.

3 Claims, 16 Drawing Sheets

(51) Int. Cl.
*F02D 41/12* (2006.01)
*F01M 13/02* (2006.01)

(56) References Cited

U.S. PATENT DOCUMENTS

| | | | | |
|---|---|---|---|---|
| 2006/0137668 | A1* | 6/2006 | Honda | F02D 41/047 123/674 |
| 2010/0083937 | A1 | 4/2010 | Tsunooka et al. | |
| 2011/0056189 | A1* | 3/2011 | Hlrowatarl | F01M 13/00 60/284 |
| 2011/0282539 | A1* | 11/2011 | Inoue | F01M 13/022 701/31.4 |
| 2012/0109498 | A1* | 5/2012 | Murase | F02D 41/0025 701/103 |

FOREIGN PATENT DOCUMENTS

| | | |
|---|---|---|
| JP | 2007-127076 | 5/2007 |
| JP | 2008-202472 | 9/2008 |
| JP | 2010-174790 | 8/2010 |
| JP | 2011-122543 | 6/2011 |
| JP | 2011-226351 | 11/2011 |
| JP | 2012-26428 | 2/2012 |
| JP | 2012-31869 | 2/2012 |
| JP | 2012-72686 | 4/2012 |
| JP | 2012-145041 | 8/2012 |
| JP | 2013-72343 | 4/2013 |
| JP | 2013-83203 | 5/2013 |
| JP | 2014-101863 | 6/2014 |
| WO | WO 2012/146972 A1 | 11/2012 |

* cited by examiner

OIL DILUTION RATE CALCULATION SYSTEM OF INTERNAL COMBUSTION ENGINE

CROSS-REFERENCE TO RELATED APPLICATIONS

This application is a national phase application of international application No. PCT/JP2015/005607, filed Nov. 10, 2015, and claims the priority of Japanese Application No. 2014-257884, filed Nov. 10, 2015, the content of both of which is incorporated herein by reference.

TECHNICAL FIELD

The present invention relates to an oil dilution rate calculation system of an internal combustion engine.

BACKGROUND ART

In the past, there has been known an internal combustion engine which provides an air-fuel ratio sensor in an exhaust passage of the internal combustion engine and controls the amount of fuel fed to a combustion chamber of the internal combustion engine based on the output current of this air-fuel ratio sensor. The amount of fuel is controlled so that the air-fuel ratio of the air-fuel mixture burned in the combustion chamber becomes a target air-fuel ratio (for example, stoichiometric air-fuel ratio).

As one example of an air-fuel ratio sensor, there is known an air-fuel ratio sensor which linearly changes in output current (proportionally) with respect to an exhaust air-fuel ratio (for example, PTL 1). The output current becomes larger the higher the exhaust air-fuel ratio (the leaner). For this reason, the exhaust air-fuel ratio can be estimated by detecting the output current of the air-fuel ratio sensor.

In this regard, in an internal combustion engine, air-fuel mixture leaks out from a clearance between a piston and a cylinder block to the inside of a crankcase, that is, "blowby gas" is generated. If the blowby gas remains inside the crankcase, it will cause deterioration of the engine oil, corrosion of metal, air pollution, etc. Therefore, an internal combustion engine is provided with a blowby gas passage connecting the crankcase and the intake passage. The blowby gas passes through the blowby gas passage to be returned to the intake passage and is burned together with the new air-fuel mixture.

Further, in a cylinder injection type internal combustion engine directly injecting fuel into a combustion chamber, the distance between an injection port of a fuel injector and a cylinder wall surface is extremely short, and therefore the injected fuel directly strikes the cylinder wall surface. At the time of cold startup, the fuel deposited at the cylinder wall does not easily vaporize, and therefore it leaks out from the clearance between the piston and cylinder into the crankcase and is mixed with the engine oil. In other words, the engine oil inside the crankcase is diluted by the liquid phase fuel, that is, "oil dilution" occurs. On the other hand, after the internal combustion engine is warmed up, the temperature of the engine oil also rises, and therefore the fuel content in the engine oil vaporizes. Therefore, at the time of cold startup, if the internal combustion engine is warmed up while the amount of fuel contained in engine oil is small, the oil dilution rate will not increase much at all. Note that, the "oil dilution rate" is the value of the amount of fuel mixed in the engine oil divided by the amount of the engine oil.

However, if an operating state where the internal combustion engine is started at a low temperature and is stopped in a shorter time than the time by which the internal combustion engine is warmed up, a so-called "short trip", is repeated, the amount of fuel content in the engine oil will increase. The oil dilution rate also increases. After that, if the internal combustion engine is warmed up, the large amount of fuel in the engine oil will vaporize, and therefore the fuel content in the blowby gas will increase. As a result, blowby gas containing a large amount of fuel will pass through the blowby gas passage and flow into the intake passage. For this reason, even if the amount of fuel injected from a fuel injector is controlled so that the air-fuel ratio of the air-fuel mixture becomes the target air-fuel ratio, a large amount of fuel is fed from the blowby gas passage, and therefore the air-fuel ratio deviates to the rich side with respect to the target air-fuel ratio. This sometimes causes obstructions to the various types of control of the air-fuel ratio such as air-fuel ratio feedback processing, and in turn causes deterioration of the driveability or exhaust emissions.

Therefore, in the control system of an internal combustion engine described in PTL 2, if oil dilution occurs, updating of the learning value of the air-fuel ratio for causing convergence of the amount of feedback correction of the air-fuel ratio calculated based on the exhaust air-fuel ratio to within a predetermined reference amount of correction is prohibited. However, to perform such control, it is necessary to precisely calculate the oil dilution rate for judging if oil dilution is occurring.

Further, an air-fuel ratio sensor gradually deteriorates along with use and sometimes changes in gain characteristics. If the gain characteristics change, the output current of the air-fuel ratio sensor becomes too large or too small for the exhaust air-fuel ratio. As a result, the exhaust air-fuel ratio is mistakenly estimated, and therefore the various types of control carried out by a control device of the internal combustion engine end up being obstructed.

Therefore, PTL 3 proposes an abnormality diagnosis system diagnosing abnormality in an air-fuel ratio sensor. In such an abnormality diagnosis system, during fuel cut control wherein the internal combustion engine stops the feed of fuel to the combustion chamber, abnormality of the air-fuel ratio sensor is diagnosed based on the value of the applied voltage of the air-fuel ratio sensor. According to PTL 2, during fuel cut control, the exhaust air-fuel ratio is constant and can be recognized, and therefore it is possible to accurately diagnose abnormality of an air-fuel ratio sensor without being influenced by fluctuations in the exhaust air-fuel ratio.

However, if oil dilution causes blowby gas containing a large amount of fuel to flow through the blowby gas passage to the intake passage, a large amount of fuel will be mixed into the air taken into a cylinder during fuel cut control. Due to this fuel, the oxygen in the exhaust gas will be consumed in the exhaust passage, in particular in the exhaust purification catalyst, and therefore the exhaust air-fuel ratio during fuel cut control will be decreased.

However, in the abnormality diagnosis system described in PTL 3, fluctuation of the exhaust air-fuel ratio during fuel cut control is not considered at all. For this reason, in this abnormality diagnosis system, if oil dilution causes the exhaust air-fuel ratio to decrease during fuel cut control, it will not be possible to accurately diagnose abnormality of the air-fuel ratio sensor. Specifically, even if the air-fuel ratio sensor is normal, if oil dilution causes the exhaust air-fuel ratio to decrease during fuel cut control, the output current of the air-fuel ratio sensor and in turn the applied voltage will decrease, and therefore the normal air-fuel ratio sensor is liable to be mistakenly diagnosed as abnormal. Alternatively, if an increase in the output current and in turn the applied voltage due to an abnormality of an air-fuel ratio sensor is cancelled out by a decrease in the output current and in turn applied voltage due to a decrease in the exhaust air-fuel ratio during fuel cut control, the abnormal air-fuel ratio sensor will be misdiagnosed as normal. Therefore, to precisely diagnose abnormality of an air-fuel ratio sensor, it is desirable to know in advance the oil dilution rate at the time of abnormality diagnosis.

Therefore, in the internal combustion engine described in PTL 4, the oil dilution rate is calculated based on the amount of feedback correction of the fuel injection amount or the learning value of the amount of feedback correction (value showing amount of lasting deviation of the fuel injection amount). Further, in the internal combustion engine described in PTL 5, the viscosity of the engine oil is directly measured by a viscosity sensor to calculate the oil dilution rate, while in the internal combustion engine described in PTL 6, the oil dilution rate is directly measured by an alcohol concentration sensor.

CITATION LIST

Patent Literature

PTL 1: Japanese Patent Publication No. 2002-243694A
PTL 2: Japanese Patent Publication No. 2011-122543A
PTL 3: Japanese Patent Publication No. 2010-174790A
PTL 4: Japanese Patent Publication No. 2014-101863A
PTL 5: Japanese Patent Publication No. 2012-031869A
PTL 6: Japanese Patent Publication No. 2008-202472A
PTL 7: Japanese Patent Publication No. 2007-127076A
PTL 8: Japanese Patent Publication No. 2011-226351A

SUMMARY OF INVENTION

Technical Problem

However, the amount of feedback correction of the fuel injection amount or the learning value of the amount of feedback correction changes due to variation in the fuel injection amount in addition to the oil dilution rate. Therefore, in the method described in PTL 4, sometimes it is not possible to precisely calculate the oil dilution rate. Further, newly providing a sensor etc. for calculating the oil dilution rate such as in the internal combustion engines described in PTLs 5 and 6 causes the cost of the internal combustion engine to increase.

Therefore, in view of the above issues, an object of the present invention is to provide an oil dilution calculation system of an internal combustion engine which enables an oil dilution rate of a fuel injection amount to be precisely calculated without newly providing a sensor etc. for calculating the oil dilution rate.

Solution to Problem

In order to solve the above problem, in a first invention, there is provided an oil dilution rate calculation system of an internal combustion engine, wherein the internal combustion engine has an intake passage in which a throttle valve is arranged and which leads an air-fuel mixture containing air and fuel to a combustion chamber, an exhaust passage discharging exhaust gas produced by combustion of the air-fuel mixture in the combustion chamber, a blowby gas passage returning blowby gas in a crankcase to the downstream side of the throttle valve in the intake passage, and an air-fuel ratio sensor provided in the exhaust passage and detecting an air-fuel ratio of the exhaust gas flowing through the exhaust passage, and the oil dilution rate calculation system is configured to acquire a blowby gas flow ratio showing the ratio of the flow of blowby gas to the flow of gas to the combustion chamber and an output current of the air-fuel ratio sensor during fuel cut control in which the internal combustion engine stops the feed of fuel to the combustion chamber and at a plurality of points of time of different flows of blowby gas passing through the blowby gas passage and flowing to the downstream side of the throttle valve in the intake passage, and calculate an oil dilution rate based on the blowby gas flow ratio and output current.

In a second invention, the plurality of points of time are a plurality of points of time at a single cycle of fuel cut control in a first invention.

In a third invention, the oil dilution rate calculation system is configured to calculate the amount of change of the blowby gas flow ratios acquired at the plurality of points of time, and not calculate the oil dilution rate when the amount of change is less than a predetermined value in a first or second invention.

In a forth invention, the oil dilution rate calculation system is configured to acquire values of a variation factor causing the output current of the air-fuel ratio sensor to fluctuate, other than the air-fuel ratio of the exhaust gas, at the plurality of points of time, calculate an amount of change of the values of the variation factor, and not calculate the oil dilution rate when the amount of change is a predetermined value or more in any one of the first to third inventions.

Advantageous Effects of Invention

According to the present invention, it is possible to provide an oil dilution calculation system of an internal combustion engine which enables an oil dilution rate of a fuel injection amount to be precisely calculated without newly providing a sensor etc. for calculating the oil dilution rate.

DESCRIPTION OF EMBODIMENTS

Figure 1:
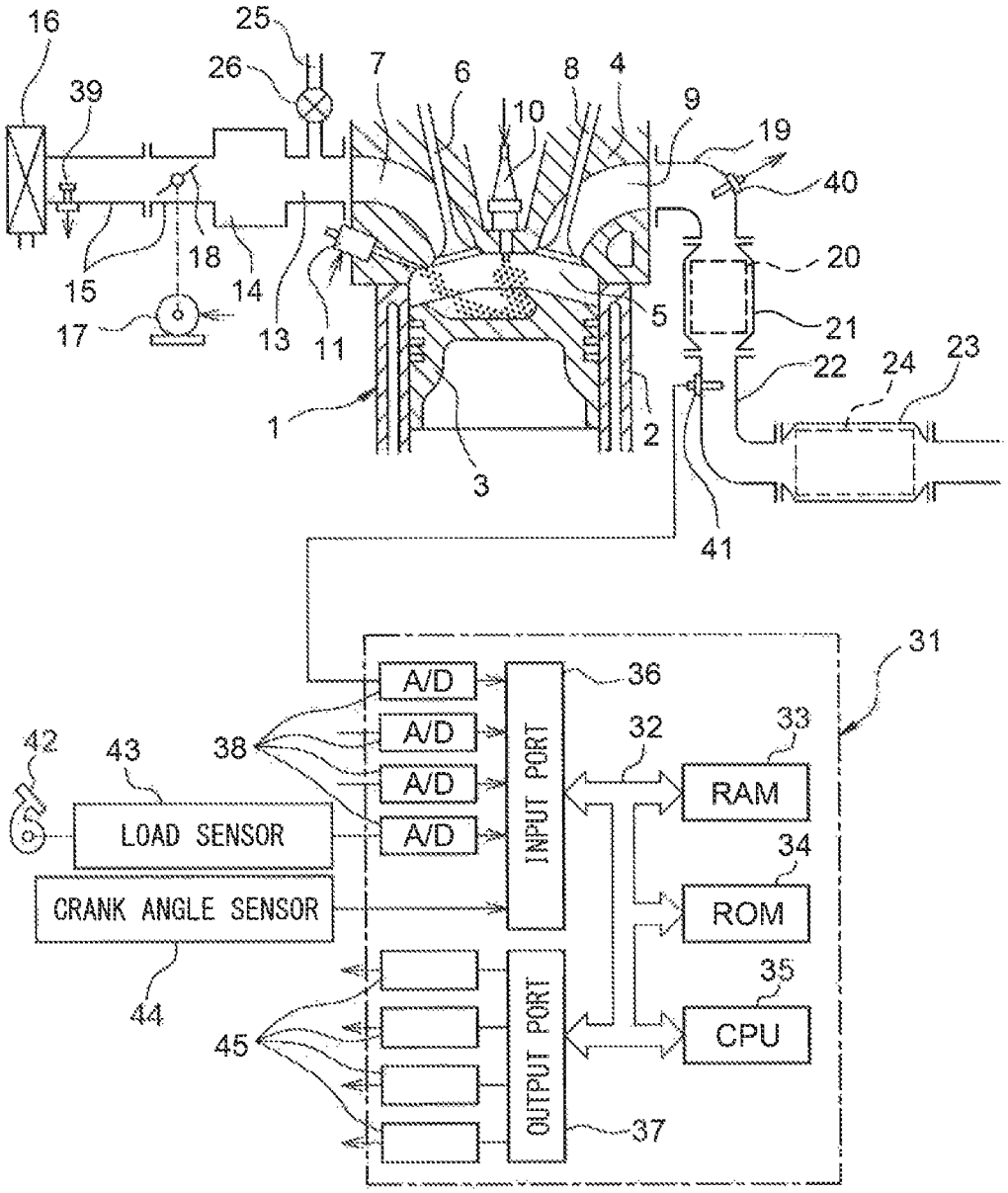
FIG. 1 is a view schematically showing an internal combustion engine in which an oil dilution rate calculation system according to an embodiment of the present invention is used.

Referring to the drawings, an embodiment of the present invention will be explained in detail below. Note that, in the following explanation, similar component elements are assigned the same reference numerals.

<Explanation of Internal Combustion Engine as a Whole>

FIG. 1 is a view which schematically shows an internal combustion engine in which an oil dilution rate calculation system according to an embodiment of the present invention is used. Referring to FIG. 1, 1 indicates an engine body, 2 a cylinder block, 3 a piston which reciprocates inside the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, at the center part of the inside wall surface of the cylinder head 4, a spark plug 10 is arranged. A fuel injector 11 is arranged around the inside wall surface of the cylinder head 4. The spark plug 10 is configured to cause generation of a spark in accordance with an ignition signal. Further, the fuel injector 11 directly injects a predetermined amount of fuel into the combustion chamber 5 in accordance with an injection signal. That is, the internal combustion engine of the present embodiment is a cylinder injection type internal combustion engine. Note that, the internal combustion engine may also be a port injection type internal combustion engine. In this case, the fuel injector 11 is arranged so as to inject fuel inside the intake port 7. Further, in the present embodiment, as the fuel, gasoline with a stoichiometric air-fuel ratio of 14.6 is used. However, in the internal combustion engine in which the oil dilution rate calculation system of the present invention is used, another fuel may also be used.

The intake port 7 in each cylinder is connected through a corresponding intake runner 13 to a surge tank 14. The surge tank 14 is connected through an intake pipe 15 to an air cleaner 16. The intake port 7, intake runner 13, surge tank 14, and intake pipe 15 form an intake passage which leads an air-fuel mixture which contains air and fuel to a combustion chamber 5. Further, inside the intake pipe 15, a throttle valve 18 which is driven by a throttle valve drive actuator 17 is arranged. The throttle valve 18 can be turned by the throttle valve drive actuator 17 to thereby change the opening area of the intake passage.

On the other hand, the exhaust port 9 in each cylinder is connected to an exhaust manifold 19. The exhaust manifold 19 has a plurality of runners which are connected to the exhaust ports 9 and a header at which these runners are collected. The header of the exhaust manifold 19 is connected to an upstream side casing 21 which has an upstream side exhaust purification catalyst 20 built into it. The upstream side casing 21 is connected through an exhaust pipe 22 to a downstream side casing 23 which has a downstream side exhaust purification catalyst 24 built into it. The exhaust port 9, exhaust manifold 19, upstream side casing 21, exhaust pipe 22, and downstream side casing 23 form an exhaust passage which discharges exhaust gas produced due to combustion of the air-fuel mixture in the combustion chamber 5.

Further, an intake runner 13 is connected through a blowby gas passage 25 to the crankcase. Inside the blowby gas passage 25, a PCV (positive crankcase ventilation) valve 26 is arranged. The PCV valve 26 is a one-way valve (check valve) which allows flow only in one direction from the crankcase to the intake runner 13. If a negative pressure occurs at the intake runner 13, the PCV valve 26 opens and air-fuel mixture leaks from the clearance between the piston 3 and the cylinder block 2 to the inside of the crankcase and so-called blowby gas runs from the inside of the crankcase through the inside of the blowby gas passage 25 to be returned to the intake runner 13. Note that, the blowby gas passage 25 may be connected to another position in the intake passage at the downstream side of the throttle valve 18, for example, the surge tank 14.

The electronic control unit (ECU) 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an air flow meter 39 is arranged for detecting the flow rate of air which flows through the intake pipe 15. The output of this air flow meter 39 is input through a corresponding AD converter 38 to the input port 36. Further, at the header of the exhaust manifold 19, an upstream side air-fuel ratio sensor 40 is arranged which detects the air-fuel ratio of the exhaust gas which flows through the inside of the exhaust manifold 19 (that is, the exhaust gas which flows into the upstream side exhaust purification catalyst 20). In addition, in the exhaust pipe 22, a downstream side air-fuel ratio sensor 41 is arranged which detects the air-fuel ratio of the exhaust gas flowing through the inside of the exhaust pipe 22 (that is, the exhaust gas which flows out from the upstream side exhaust purification catalyst 20 and flows into the downstream side exhaust purification catalyst 24). The outputs of these air-fuel ratio sensors 40 and 41 are also input through the corresponding AD converters 38 to the input port 36. Note that, the configurations of these air-fuel ratio sensors 40 and 41 will be explained later.

Further, an accelerator pedal 42 has a load sensor 43 connected to it which generates an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that, ECU 31 acts as a control system for controlling the internal combustion engine.

The upstream side exhaust purification catalyst 20 and the downstream side exhaust purification catalyst 24 are three-way catalysts which have oxygen storage abilities. Specifically, the exhaust purification catalysts 20 and 24 are comprised of carriers comprised of ceramic on which a precious metal having a catalytic action (for example, platinum (Pt)) and a substance having an oxygen storage ability (for example, ceria ($CeO_2$)) are carried. The exhaust purification catalysts 20 and 24 exhibit a catalytic action of simultaneously removing unburned gas (HC, CO, etc.) and nitrogen oxides ($NO_x$) when reaching a predetermined activation temperature and, in addition, an oxygen storage ability.

According to the oxygen storage ability of the exhaust purification catalysts 20 and 24, the exhaust purification catalysts 20 and 24 store the oxygen in the exhaust gas when the air-fuel ratio of the exhaust gas flowing into the exhaust purification catalysts 20 and 24 is an air-fuel ratio leaner than the stoichiometric air-fuel ratio (hereinafter, also referred to as "lean air-fuel ratio"). On the other hand, the exhaust purification catalysts 20 and 24 release the oxygen stored in the exhaust purification catalysts 20 and 24 when the inflowing exhaust gas has an air-fuel ratio richer than the stoichiometric air-fuel ratio (hereinafter, also referred to as "rich air-fuel ratio"). As a result, as long as the oxygen storage ability of the exhaust purification catalysts 20 and 24 is maintained, the air-fuel ratio of the exhaust gas flowing out from the exhaust purification catalysts 20 and 24 becomes substantially stoichiometric air-fuel ratio, regardless the air-fuel ratio of the exhaust gas flowing into the exhaust purification catalyst 20 and 24.

<Explanation of Air-Fuel Ratio Sensor>

Figure 2:
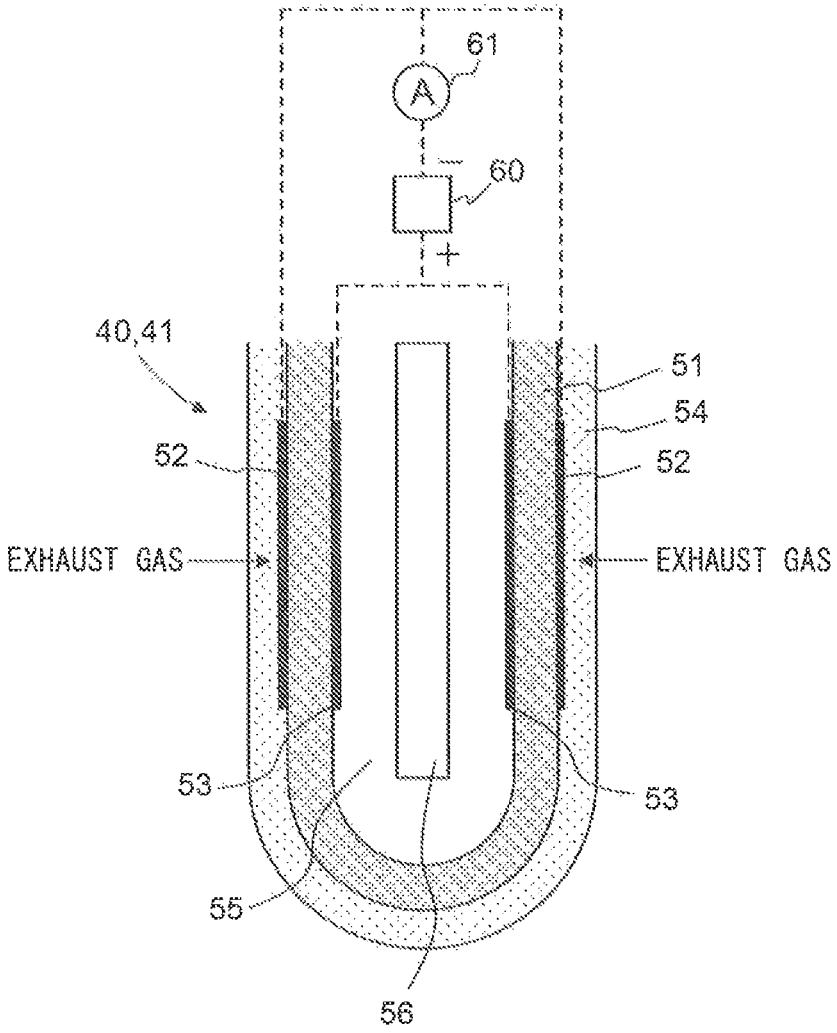
FIG. 2 is a view schematically showing the structure of an air-fuel ratio sensor.

In the present embodiment, as the air-fuel ratio sensors 40 and 41, cup type limit current type air-fuel ratio sensors are used. Referring to FIG. 2, the structures of the air-fuel ratio sensors 40 and 41 are simply explained. FIG. 2 is a view which schematically shows the structure of an air-fuel ratio sensor. Each of the air-fuel ratio sensors 40 and 41 is provided with a solid electrolyte layer 51, an exhaust side electrode 52 arranged on one side surface of the solid electrolyte layer 51, an atmosphere side electrode 53 arranged on the other side surface of the solid electrolyte layer 51, a diffusion regulation layer 54 regulating the diffusion of the flowing exhaust gas, a reference gas chamber 55, and a heater part 56 heating the air-fuel ratio sensor 40 or 41, in particular the electrolyte layer (element) 51.

In each of the cup type air-fuel ratio sensors 40 and 41 of the present embodiment, the solid electrolyte layer 51 is formed into a cylindrical shape with one closed end. Inside of the reference gas chamber 55 defined inside of the air-fuel ratio sensor 40 or 41, atmospheric gas (air) is introduced and the heater part 56 is arranged. On the inside surface of the solid electrolyte layer 51, an atmosphere side electrode 53 is arranged. On the outside surface of the solid electrolyte layer 51, an exhaust side electrode 52 is arranged. On the outside surfaces of the solid electrolyte layer 51 and the exhaust side electrode 52, a diffusion regulation layer 54 is arranged to cover the solid electrolyte layer 51 and the exhaust side electrode 52. Note that, at the outside of the diffusion regulation layer 54, a protective layer (not shown) may be provided for preventing a liquid etc. from depositing on the surface of the diffusion regulation layer 54.

The solid electrolyte layer 51 is formed by a sintered body of $ZrO_2$ (zirconia), $HfO_2$, $ThO_2$, $Bi_2O_3$, or other oxygen ion conducting oxide in which CaO, MgO, $Y_2O_3$, $Yb_2O_3$, etc. is blended as a stabilizer. Further, the diffusion regulation layer 54 is formed by a porous sintered body of alumina, magnesia, silica, spinel, mullite, or another heat resistant inorganic substance. Furthermore, the exhaust side electrode 52 and atmosphere side electrode 53 is formed by platinum or other precious metal with a high catalytic activity.

Further, between the exhaust side electrode 52 and the atmosphere side electrode 53, sensor applied voltage V is supplied by the voltage control device 60 mounted on the ECU 31. In addition, the ECU 31 is provided with a current detection device 61 which detects the current flowing between these electrodes 52 and 53 through the solid electrolyte layer 51 when the sensor applied voltage is supplied. The current which is detected by this current detection device 61 is the output current of the air-fuel ratio sensors 40 and 41.

Figure 3:
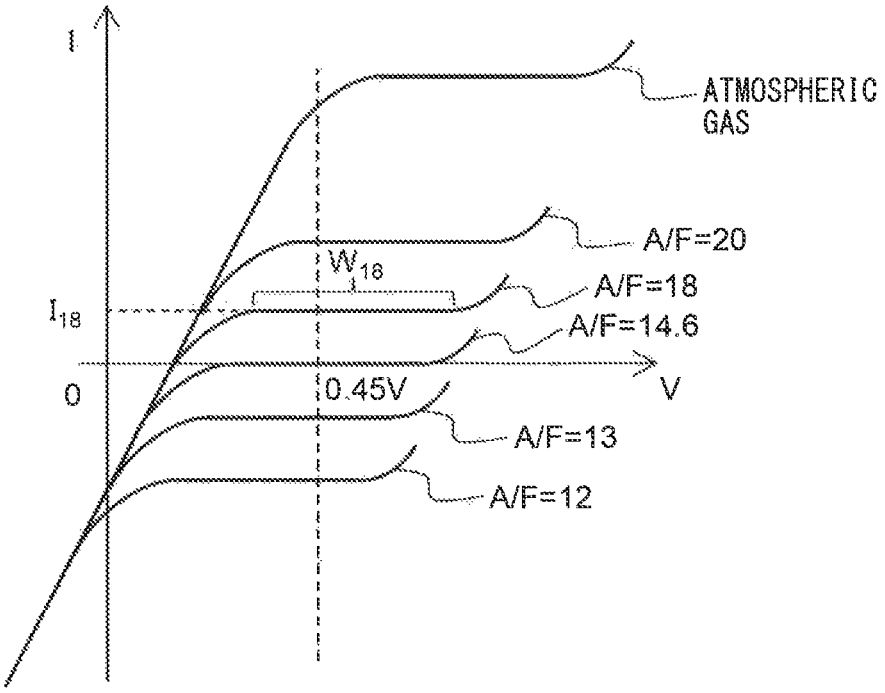
FIG. 3 is a view showing the relationship between a sensor applied voltage and output current at different exhaust air-fuel ratios.

The thus configured air-fuel ratio sensors 40 and 41 have the voltage-current (V-I) characteristic such as shown in FIG. 3. FIG. 3 is a view which shows the relationship between sensor applied voltage and output current at different exhaust air-fuel ratios. As will be understood from FIG. 3, the output current I becomes larger the higher the exhaust air-fuel ratio (the leaner). Further, at the line V-I of each exhaust air-fuel ratio, there is a region parallel to the V axis, that is, a region where the output current does not change much at all even if the sensor applied voltage changes. This voltage region is called the "limit current region". The current at this time is called the "limit current". In FIG. 3, the limit current region and limit current when the exhaust air-fuel ratio is 18 are shown by $W_{18}$ and $I_{18}$.

On the other hand, in the region where the sensor applied voltage is lower than the limit current region, the output current changes substantially proportionally to the sensor applied voltage. Below, this region will be referred to as the "proportional region". The slope at this time is determined by the DC element resistance of the solid electrolyte layer 51. Further, in the region where the sensor applied voltage is higher than the limit current region, the output current also increases along with the increase in the sensor applied voltage. In this region, breakdown of the moisture, which is contained in the exhaust gas, on the exhaust side electrode 52, etc. causes the output current to change according to change of the sensor applied voltage. This region will be referred to as the "moisture breakdown region" below.

Figure 4:
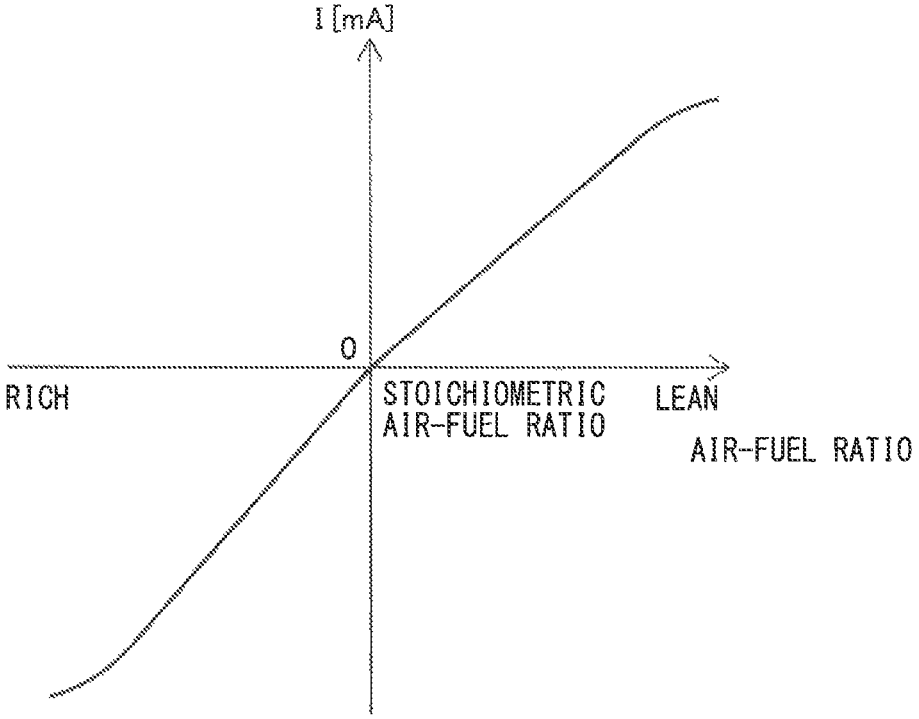
FIG. 4 is a view showing the relationship between an exhaust air-fuel ratio and output current when making the sensor applied voltage constant.

FIG. 4 is a view which shows the relationship between the exhaust air-fuel ratio and the output current I when making the supplied voltage constant at about 0.45V. As will be understood from FIG. 4, in the air-fuel ratio sensors 40 and 41, the output current I changes linearly (proportionally) with respect to the exhaust air-fuel ratio so that the higher the exhaust air-fuel ratio (that is, the leaner), the greater the output current I from the air-fuel ratio sensors 40 and 41. In addition, the air-fuel ratio sensors 40 and 41 are configured so that the output current I becomes zero when the exhaust air-fuel ratio is the stoichiometric air-fuel ratio. Further, when the exhaust air-fuel ratio becomes larger by a certain extent or more or when it becomes smaller by a certain extent or more, the ratio of change of the output current to the change of the exhaust air-fuel ratio becomes smaller.

Note that, in the above example, as the air-fuel ratio sensors 40 and 41, limit current type air-fuel ratio sensors of the structure shown in FIG. 2 are used. However, any type of air-fuel ratio sensor can be used as the air-fuel ratio sensors 40 and 41, as long as the output current linearly changes with respect to the exhaust air-fuel ratio. Therefore, as the air-fuel ratio sensors 40 and 41, for example, it is also possible to use a layered-type limit current type air-fuel ratio sensor or other structure of limit current type air-fuel ratio sensor or air-fuel ratio sensor not a limit current type or any other air-fuel ratio sensor. Further, the air-fuel ratio sensors 40 and 41 may be air-fuel ratio sensors having different construction from each other.

<Basic Air-Fuel Ratio Control>

In the thus configured internal combustion engine, based on the outputs of the air-fuel ratio sensors 40 and 41, the amount of fuel injection from the fuel injector 11 is set so that the air-fuel ratio of the exhaust gas flowing into the upstream side exhaust purification catalyst 20 becomes the optimum air-fuel ratio based on the engine operating state. In the present embodiment, based on the output current of the upstream side air-fuel ratio sensor 40 (corresponding to air-fuel ratio of exhaust gas flowing into the upstream side exhaust purification catalyst 20 or air-fuel ratio of exhaust gas flowing out from the engine body), feedback control is carried out so that this output current becomes a value corresponding to the target air-fuel ratio. In addition, the target air-fuel ratio is changed based on the output current of the downstream side air-fuel ratio sensor 41.

Figure 5:
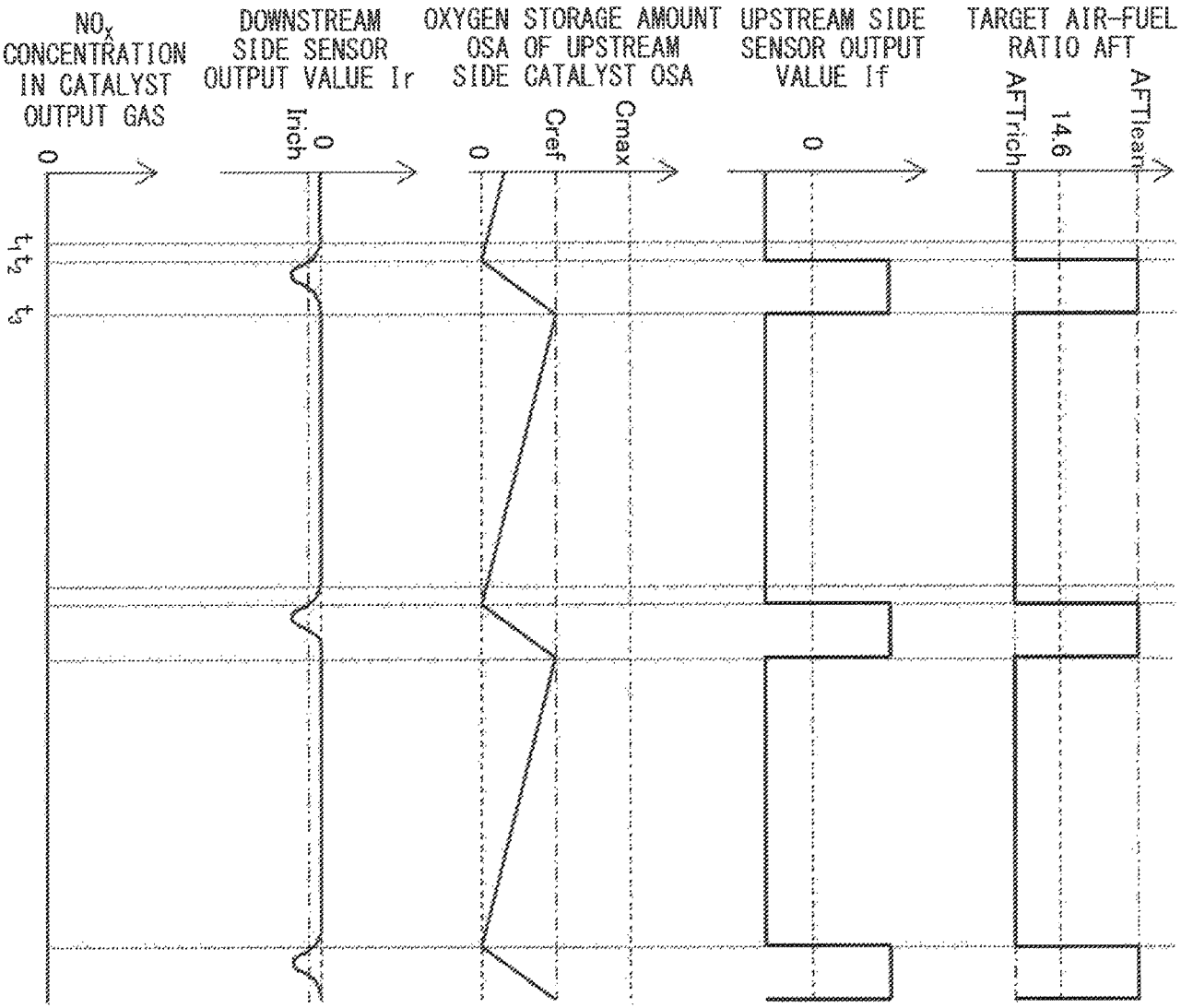
FIG. 5 is a time chart of a target air-fuel ratio etc. at the time of normal operation of an internal combustion engine.

Referring to FIG. 5, such an example of control of the target air-fuel ratio will be simply explained. FIG. 5 is a time chart of the target air-fuel ratio AFT, the output current (output value) If of the upstream side air-fuel ratio sensor 40, the oxygen storage amount OSA of the upstream side exhaust purification catalyst, and the output current (output value) Ir of the downstream side air-fuel ratio sensor 41, at the time of ordinary operation of the internal combustion engine.

Note that, the output currents of the air-fuel ratio sensors 40, 41, as shown in FIG. 4, become zero when the air-fuel ratio of the exhaust gas flowing around the air-fuel ratio sensors 40, 41 is the stoichiometric air-fuel ratio. In addition, they become negative values when the air-fuel ratio of the exhaust gas is the rich air-fuel ratio, and become positive values when the air-fuel ratio of the exhaust gas is the lean air-fuel ratio. Further, when the air-fuel ratio of the exhaust gas flowing around the air-fuel ratio sensors 40, 41 is the rich air-fuel ratio or lean air-fuel ratio, the larger the difference from the stoichiometric air-fuel ratio becomes, the larger the absolute values of the output currents of the air-fuel ratio sensors 40, 41 become. Further, the "time of normal operation (normal control)" means an operating state (control state) where control for adjusting the amount of fuel injection in accordance with a specific operating state of the internal combustion engine (for example, correction for increasing amount of fuel injection performed at time of acceleration of vehicle mounting an internal combustion engine or fuel cut control which will be explained later, etc.) is not being performed.

In the example shown in FIG. 5, when the output current Ir of the downstream side air-fuel ratio sensor 41 becomes equal to or less than a rich judgment reference value Irich smaller than zero, the target air-fuel ratio is set to and maintained at a lean set air-fuel ratio AFTlean (for example, 15) which is leaner than the stoichiometric air-fuel ratio. In this regard, the rich judgment reference value Irich is a value which corresponds to a predetermined rich judgment air-fuel ratio (for example, 14.55) which is slightly richer than the stoichiometric air-fuel ratio.

Then, the oxygen storage amount of the upstream side exhaust purification catalyst 20 is estimated. If this estimated value is equal to or greater than a predetermined judgment reference storage amount Cref (amount smaller than maximum storable oxygen amount Cmax), the target air-fuel ratio is set to and maintained at a rich set air-fuel ratio AFTrich (for example, 14.4) which is richer than the stoichiometric air-fuel ratio. In the example shown in FIG. 5, this operation is repeatedly performed.

Specifically, in the example shown in FIG. 5, before the time $t_1$, the target air-fuel ratio AFT is set to the rich set air-fuel ratio AFTrich and, accordingly, the output current If of the upstream side air-fuel ratio sensor 40 is a value smaller than zero (corresponding to rich air-fuel ratio). Further, the upstream side exhaust purification catalyst 20 stores oxygen, and therefore the output current Ir of the downstream side air-fuel ratio sensor 41 becomes substantially zero (corresponding to stoichiometric air-fuel ratio). At this time, the air-fuel ratio of the exhaust gas flowing into the upstream side exhaust purification catalyst 20 becomes a rich air-fuel ratio, and therefore the upstream side exhaust purification catalyst 20 gradually falls in oxygen storage amount.

Then, at the time $t_1$, the oxygen storage amount of the upstream side exhaust purification catalyst 20 approaches zero, whereby part of the unburned gas flowing into the upstream side exhaust purification catalyst 20 starts to flow out without being purified at the upstream side exhaust purification catalyst 20. As a result, at the time $t_2$, the output current Ir of the downstream side air-fuel ratio sensor 41 becomes equal to or less than the rich judgment reference value Irich (corresponding to rich judgment reference air-fuel ratio). At this time, the target air-fuel ratio is switched from the rich set air-fuel ratio AFTrich to the lean set air-fuel ratio AFTlean.

By switching the target air-fuel ratio, the air-fuel ratio of the exhaust gas flowing into the upstream side exhaust purification catalyst 20 becomes a lean air-fuel ratio, and the outflow of unburned gas decreases and stops. Further, the oxygen storage amount OSA of the upstream side exhaust purification catalyst 20 gradually increases and, at the time $t_3$, reaches the judgment reference storage amount Cref. If, in this way, the oxygen storage amount reaches the judgment reference storage amount Cref, the target air-fuel ratio again is switched from the lean set air-fuel ratio AFTlean to the rich set air-fuel ratio AFTrich. By this switching of the target air-fuel ratio, the air-fuel ratio of the exhaust gas flowing into the upstream side exhaust purification catalyst 20 again becomes a rich air-fuel ratio. As a result, the oxygen storage amount of the upstream side exhaust purification catalyst 20 gradually decreases. Then, such operation is repeatedly performed. By performing such control, outflow of $NO_x$ from the upstream side exhaust purification catalyst 20 can be prevented.

Note that, the control of the air-fuel ratio performed at the time of normal operation is not necessarily limited to control such as explained above, based on the outputs of the upstream side air-fuel ratio sensor 40 and downstream side air-fuel ratio sensor 41. So long as control based on the outputs of these air-fuel ratio sensors 40, 41, it may be any control.

<Fuel Cut Control>

Further, in the internal combustion engine of the present embodiment, at the time of deceleration of the vehicle mounting the internal combustion engine, etc., fuel cut control is performed for stopping the injection of fuel from the fuel injector 11 to stop the feed of fuel into the combustion chamber 5 during operation of the internal combustion engine. This fuel cut control is started when a predetermined condition for start of fuel cut stands. Specifically, fuel cut control is, for example, performed when the amount of depression of the accelerator pedal 42 is zero or substantially zero (that is, engine load is zero or substantially zero) and the engine speed is equal to or greater than a predetermined speed higher than the speed at the time of idling.

When fuel cut control is performed, air or exhaust gas similar to air is exhausted from the internal combustion engine, and therefore gas with an extremely high air-fuel ratio (that is, extremely high lean degree) flows into the upstream side exhaust purification catalyst 20. As a result, during fuel cut control, a large amount of oxygen flows into the upstream side exhaust purification catalyst 20, and the oxygen storage amount of the upstream side exhaust purification catalyst 20 reaches the maximum storable oxygen amount.

Further, the fuel cut control is made to end if a predetermined condition for ending the fuel cut stands. As the condition for ending the fuel cut, for example, the amount of depression of the accelerator pedal 42 becoming a predetermined value or more (that is, the engine load becoming a certain extent of value) or the engine speed becoming equal to or less than a predetermined speed higher than the speed at the time of idling, etc. may be mentioned. Further, in the internal combustion engine of the present embodiment, right after the end of the fuel cut control, post-return rich control is performed which makes the air-fuel ratio of the exhaust gas flowing into the upstream side exhaust purification catalyst 20 a post-return rich air-fuel ratio which is richer than the rich set air-fuel ratio. Due to this, it is possible to quickly release the oxygen stored in the upstream side exhaust purification catalyst 20 during fuel cut control.

<Calculation of Oil Dilution Amount>

In this regard, when the engine oil in the crankcase is diluted due to liquid phase fuel, that is, oil dilution occurs, if the internal combustion engine is warmed up and fuel in the engine oil evaporates, the fuel content in the blowby gas will increase. For this reason, even if the amount of fuel injected from a fuel injector is controlled so that the air-fuel ratio of the air-fuel mixture becomes a target air-fuel ratio, a large amount of fuel is fed from the blowby gas passage, and therefore the air-fuel ratio deviates to the rich side with respect to the target air-fuel ratio. This sometimes causes obstacles in the various control of the air-fuel ratio such as air-fuel ratio feedback processing etc. and in turn causes deterioration of the driveability and exhaust emission.

Further, if a large amount of fuel is fed from the blowby gas passage during fuel cut control, this fuel causes oxygen in the exhaust gas to be consumed in the exhaust passage, in particular the exhaust purification catalyst, and therefore the exhaust air-fuel ratio in the fuel cut control decreases. As a result, diagnosis of abnormality of the air-fuel ratio sensor 40 or 41 performed during fuel cut control is liable to not be performed accurately.

Therefore, to suppress deterioration of the driveability or exhaust emission and precisely diagnose abnormality of the air-fuel ratio sensor 40 or 41, it is necessary to precisely calculate the oil dilution rate. Note that, the "oil dilution rate" is the amount of fuel mixed into the engine oil divided by the amount of engine oil.

Therefore, the internal combustion engine of the present embodiment is provided with an oil dilution rate calculation system calculating the oil dilution rate. The oil dilution rate calculation system of an internal combustion engine according to an embodiment of the present invention acquires a blowby gas flow ratio showing a ratio of the blowby gas flow to the flow of gas flowing into the combustion chamber 5 and an output current of the air-fuel ratio sensor 40 or 41 during fuel cut control and at a plurality of points of time of different flows of blowby gas passing through the blowby gas passage 25 and flowing to the downstream side of the throttle valve 18 in the intake passage, and calculates the oil dilution rate based on the acquired blowby gas flow ratio and output current.

<Principle of Present Invention>

Figure 6:
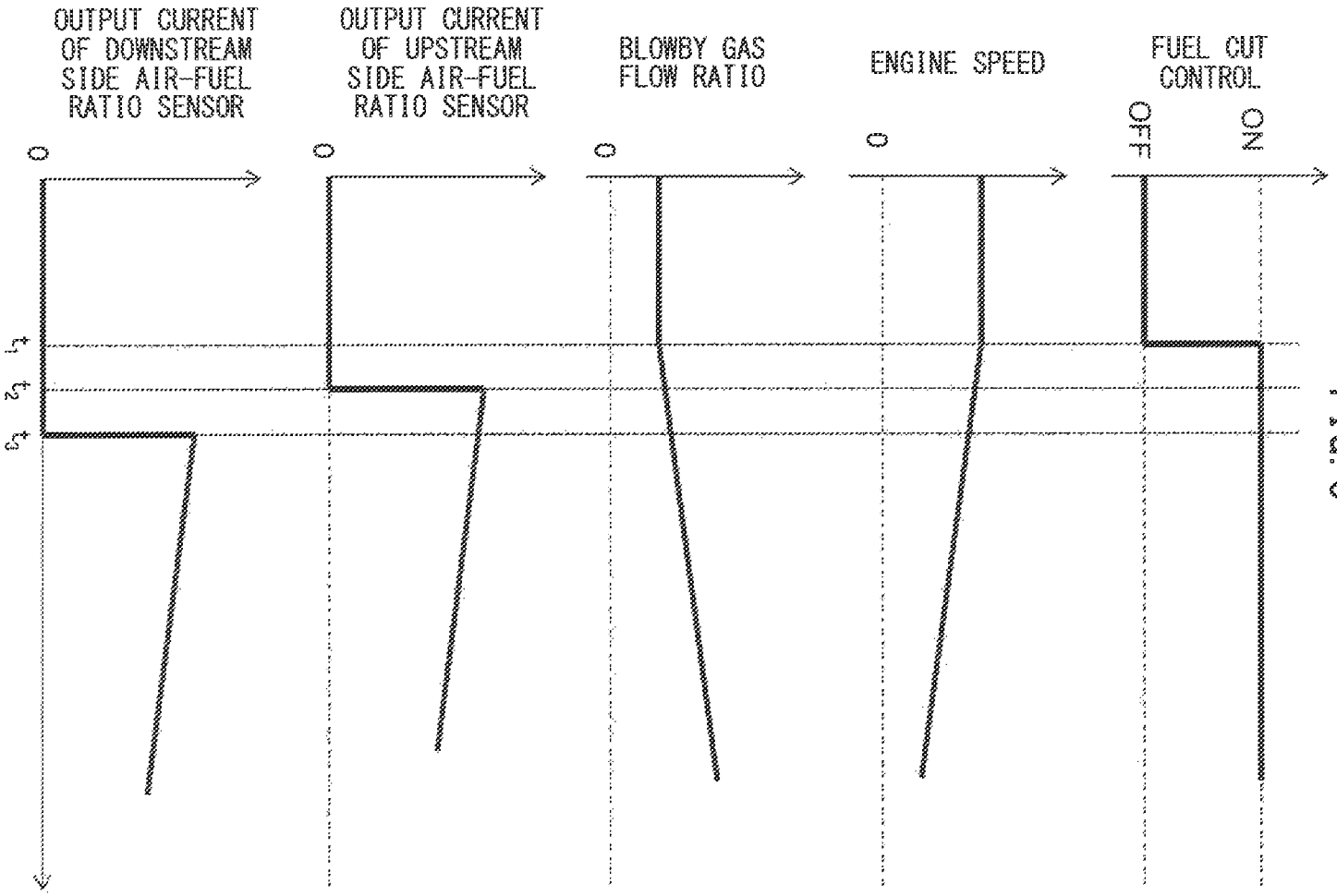
FIG. 6 is a schematic time chart of engine speed etc. before and after fuel cut control of an internal combustion engine.

First, referring to FIG. 6, one example of the changes in the engine speed, blowby gas flow ratio, output current of the upstream side air-fuel ratio sensor 40, and output current of the downstream side air-fuel ratio sensor 41 before and after fuel cut control will be explained. FIG. 6 is a schematic time chart of the engine speed, blowby gas flow ratio, output current of the upstream side air-fuel ratio sensor 40, and output current of the downstream side air-fuel ratio sensor 41 before and after fuel cut control of the internal combustion engine.

In the example which is shown in FIG. 6, before fuel cut control, the target air-fuel ratio is made the stoichiometric air-fuel ratio, and the output current of the upstream side air-fuel ratio sensor 40 and the output current of the downstream side air-fuel ratio sensor 41 are zero. Further, the engine speed and blowby gas flow ratio before fuel cut control are constant.

In the example shown in FIG. 6, at the time $t_1$, fuel cut control is started. After the start of fuel cut control, the engine speed usually decrease along with time, except when driving on a descending slope etc. If the engine speed decreases, usually the pressure in the intake passage at the downstream side of the throttle valve 18 decreases (becomes negative pressure), and therefore the flow of blowby gas flowing into the intake passage and in turn the blowby gas flow ratio increases.

At the time $t_2$ after start of fuel cut control, if the air fed into the combustion chamber 5 along with fuel cut control reaches the upstream side air-fuel ratio sensor 40, the output current of the upstream side air-fuel ratio sensor 40 becomes a value larger than zero. Further, after the time $t_2$, if air flows into the upstream side exhaust purification catalyst 20, the oxygen storage amount of the upstream side exhaust purification catalyst 20 reaches the maximum storable oxygen amount. For this reason, in the illustrated example, at the time $t_3$, the air reaches the downstream side air-fuel ratio sensor 41, and the output current of the downstream side air-fuel ratio sensor 41 becomes a value larger than zero.

If the increase in the blowby gas flow ratio causes an increase in the oxygen in the exhaust gas consumed by the fuel in the blowby gas, the exhaust air-fuel ratio and in turn the output currents of the air-fuel ratio sensors 40 and 41 will fall. In this example, after fuel cut control, the blowby gas flow ratio gradually increases, and therefore as shown in FIG. 6, the air reaches the air-fuel ratio sensors 40 and 41, then the output currents of the air-fuel ratio sensors 40 and 41 gradually fall.

Note that, in the example shown in FIG. 6, to facilitate understanding of the explanation, a simple model was explained, but the engine speed etc. do not necessarily change as shown in FIG. 6 before and after fuel cut control. For example, the pressure at the downstream side of the throttle valve 18 inside the intake passage is influenced by the intake temperature of the intake passage, the opening degree of the throttle valve 18, etc. in addition to the engine speed, and therefore in actuality, the blowby gas flow ratio can change different from the time chart shown in FIG. 6.

In the present invention, when calculating an oil dilution rate using the the upstream side air-fuel ratio sensor 40, the blowby gas flow ratio and output current of the upstream side air-fuel ratio sensor 40 are acquired at a plurality of points of time from the time $t_2$ on. Further, when calculating an oil dilution rate using the downstream side air-fuel ratio sensor 41, the blowby gas flow ratio and the output current of the downstream side air-fuel ratio sensor 41 are acquired at a plurality of points of time from the time $t_3$ on.

Figure 7:
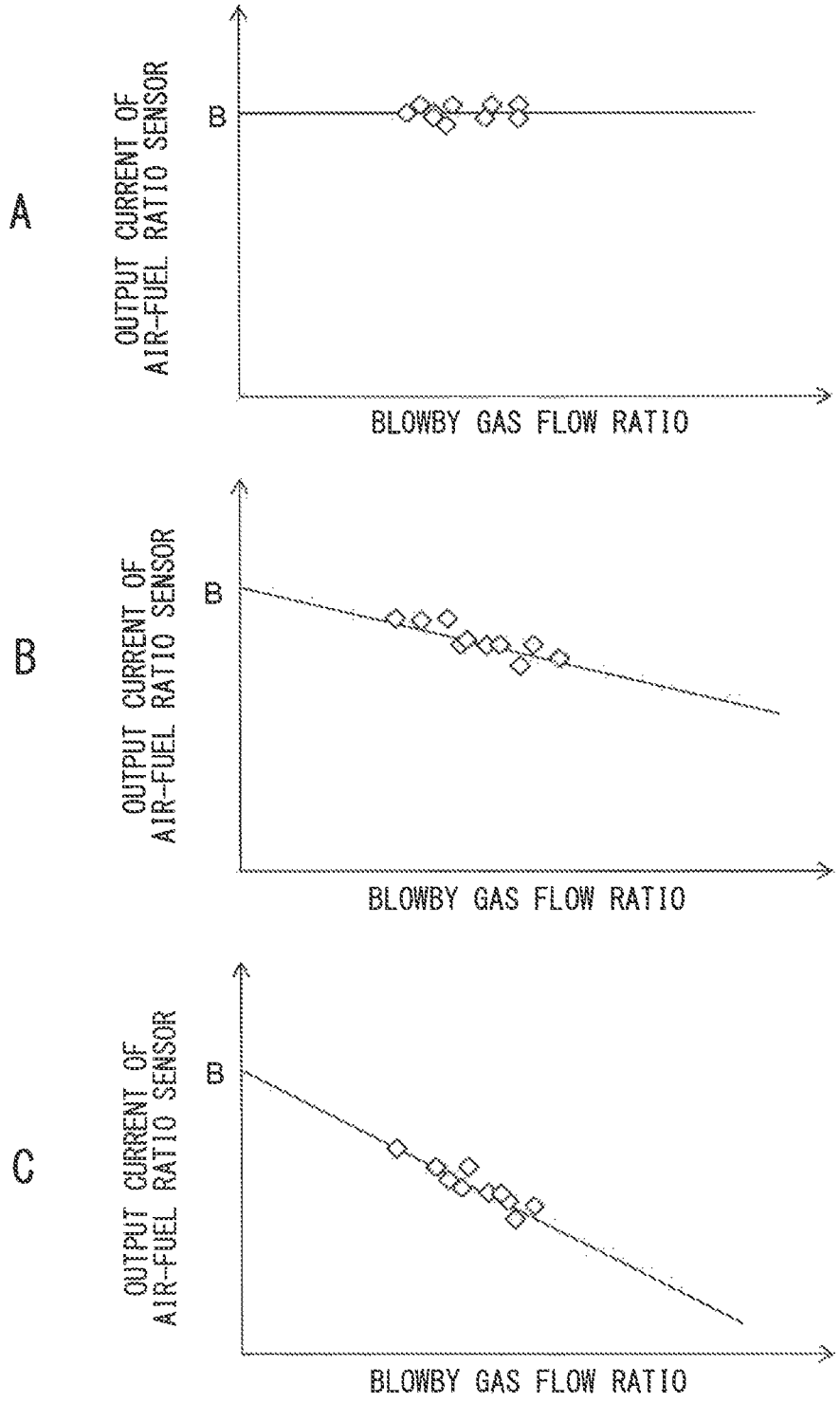
FIG. 7 is graph showing the relationship between a blowby gas flow ratio and output current of an air-fuel ratio sensor during fuel cut control.

As a result, graphs such as shown in FIGS. 7A to 7C are obtained in accordance with the amount of fuel contained in the flow of blowby gas, and in turn an oil dilution rate. FIGS. 7A to 7C are graphs which show the relationship between the blowby gas flow ratio and the output current of the air-fuel ratio sensor 40 or 41 during fuel cut control. In FIGS. 7A to 7C, the values of the blowby gas flow ratio and the output current of the air-fuel ratio sensor 40 or 41 acquired at a plurality of points of time during fuel cut control are plotted on the graphs as diamond marks. Based on these values, as shown in FIGS. 7A to 7C, the relationship between the blowby gas flow ratio and the output current of the air-fuel ratio sensor 40 or 41 can be approximated by a first order line.

As explained above, if an increase in the blowby gas flow ratio causes an increase in the oxygen in the exhaust gas consumed by the fuel in the blowby gas, the exhaust air-fuel ratio and in turn the output current of the air-fuel ratio sensor 40 or 41 falls. In this case, the slope A of the first order approximation line, as shown in FIGS. 7B and 7C, becomes negative. The absolute value of the slope A becomes larger the larger the amount of fuel contained in the blowby gas, that is, becomes larger the higher the oil dilution ate. FIG. 7B shows the relationship between the blowby gas flow ratio and the output current of the air-fuel ratio sensor 40 or 41 when the fuel contained in the blowby gas is small in amount, that is, the oil dilution rate is low. FIG. 7C shows the relationship between the blowby gas flow ratio and the output current of the air-fuel ratio sensor 40 or 41 in the case where the fuel contained in the blowby gas is large in amount, that is, the oil dilution rate is high. On the other hand, if the blowby gas does not contain almost any fuel, that is, the oil dilution rate is substantially zero, as shown in FIG. 7A, the output current of the air-fuel ratio sensor 40 or 41 becomes a substantially constant value without regard as to the blowby gas flow ratio. Further, as will be understood from FIGS. 7A to 7C, the intercept "B" of the first order approximation line becomes substantially the same value regardless of the amount of fuel contained in the blowby gas if the gain of the air-fuel ratio sensor 40 or 41 is constant.

The slope A and intercept B of a first order approximation line can be calculated by the known least square method, based on the blowby gas flow ratio and the output current of the air-fuel ratio sensor 40 or 41 acquired at a plurality of points of time during the fuel cut control. Further, the relationship between the slope A and intercept B of the first order approximation line and the oil dilution rate Dilrate is calculated as follows:

First, the output current Ifc of the air-fuel ratio sensor 40 or 41 during fuel cut control is calculated based on the gain G and the concentration O2D_FC of oxygen in the exhaust gas during fuel cut control by the following equation:

$$Ifc=G\times\mathrm{Ln}(1/(1-O2D_FC)) \quad (1)$$

Note that, Ln is a natural log. Further, the concentration O2D_FC of oxygen in the exhaust gas during fuel cut control is calculated based on the concentration of oxygen in the atmosphere, that is, 0.2, and the concentration O2D_C of oxygen consumed by the fuel in the blowby gas by the following equation (2), since the fuel in the blowby gas consumes oxygen.

$$O2D_FC=0.2-O2D_C \quad (2)$$

The concentration O2D_C of oxygen consumed by the fuel in the blowby gas is calculated based on the blowby gas flow ratio PCVR, the concentration FD_B of fuel in the blowby gas, and the concentration K of oxygen consumed per concentration of fuel in the blowby gas by the following equation (3):

$$O2D_C=K\times PCVR\times FD_B \quad (3)$$

Here, the concentration FD_B of fuel in the blowby gas is calculated based on the oil dilution rate Dilrate and the concentration L of fuel in the blowby gas per oil dilution rate by the following equation (4):

$$FD_B=L\times Dil\mathrm{rate} \quad (4)$$

From the above equation (1) to equation (4), the following equation (5) is derived.

$$IL=G\times\mathrm{Ln}(1/(0.8+K\times PCVR\times L\times Dil\mathrm{rate})) \quad (5)$$

Here, if approximating the above equation (5) by a first order equation, the following equation (6) is derived:

$$IL=-G\times K\times L\times Dil\mathrm{rate}/0.8\times PCVR+G\times\mathrm{Ln}(1/0.8)$$

Therefore, the slope A and intercept B of the first order approximation line showing the relationship between the blowby gas flow ratio PCVR and the output current IL of the air-fuel ratio sensor 40 or 41 are expressed by the following equation (7) and equation (8):

$$A=-G\times K\times L\times Dil\mathrm{rate}/0.8 \quad (7)$$

$$B=G\times\mathrm{Ln}(1/0.8) \quad (8)$$

From the above two equations (7) and (8), the oil dilution rate Dilrate is calculated as follows:

$$Dil\mathrm{rate}=-0.8\times\mathrm{Ln}(1/0.8)/(K\times L)\times A/B \quad (9)$$

The concentration K of oxygen consumed per concentration of fuel in the blowby gas and the concentration L of fuel in the blowby gas per oil dilution rate are values known in advance by experiments. Therefore, it is possible to calculate the oil dilution rate Dilrate by calculating the slope A and intercept B of the first order approximation line showing the relationship between the blowby gas flow ratio PCVR and the output current IL of the air-fuel ratio sensor 40 or 41, based on the blowby gas flow ratios and the output currents of the air-fuel ratio sensor 40 or 31 acquired at a plurality of points of time during fuel cut control. The oil dilution rate calculation system of the present invention calculates the oil dilution rate when the feed of fuel to the combustion chamber is stopped, and therefore it is possible to precisely measure the oil dilution rate without being affected by variation in the fuel injection amount. Further, the air-fuel ratio sensor 40 or air-fuel ratio sensor 41 provided for controlling the amount of fuel fed to the combustion chamber of the internal combustion engine is used to calculate the oil dilution rate, and therefore there is also no need to newly provide a sensor etc. for calculating the oil dilution rate.

A plurality of embodiments of the oil dilution rate calculation system of an internal combustion engine will be explained below.

<First Embodiment>

First, referring to FIG. 8 to FIG. 11, a first embodiment of the present invention will be explained. The oil dilution rate calculation system of the first embodiment is configured to calculate the oil dilution rate based on the blowby gas flow ratios and output currents of an air-fuel ratio sensor 40 or 41 are acquired during fuel cut control and at a plurality of points of time of different flows of blowby gas passing through the blowby gas passage 25 and flowing to the downstream side of the throttle valve 18 in the intake passage.

Figure 8:
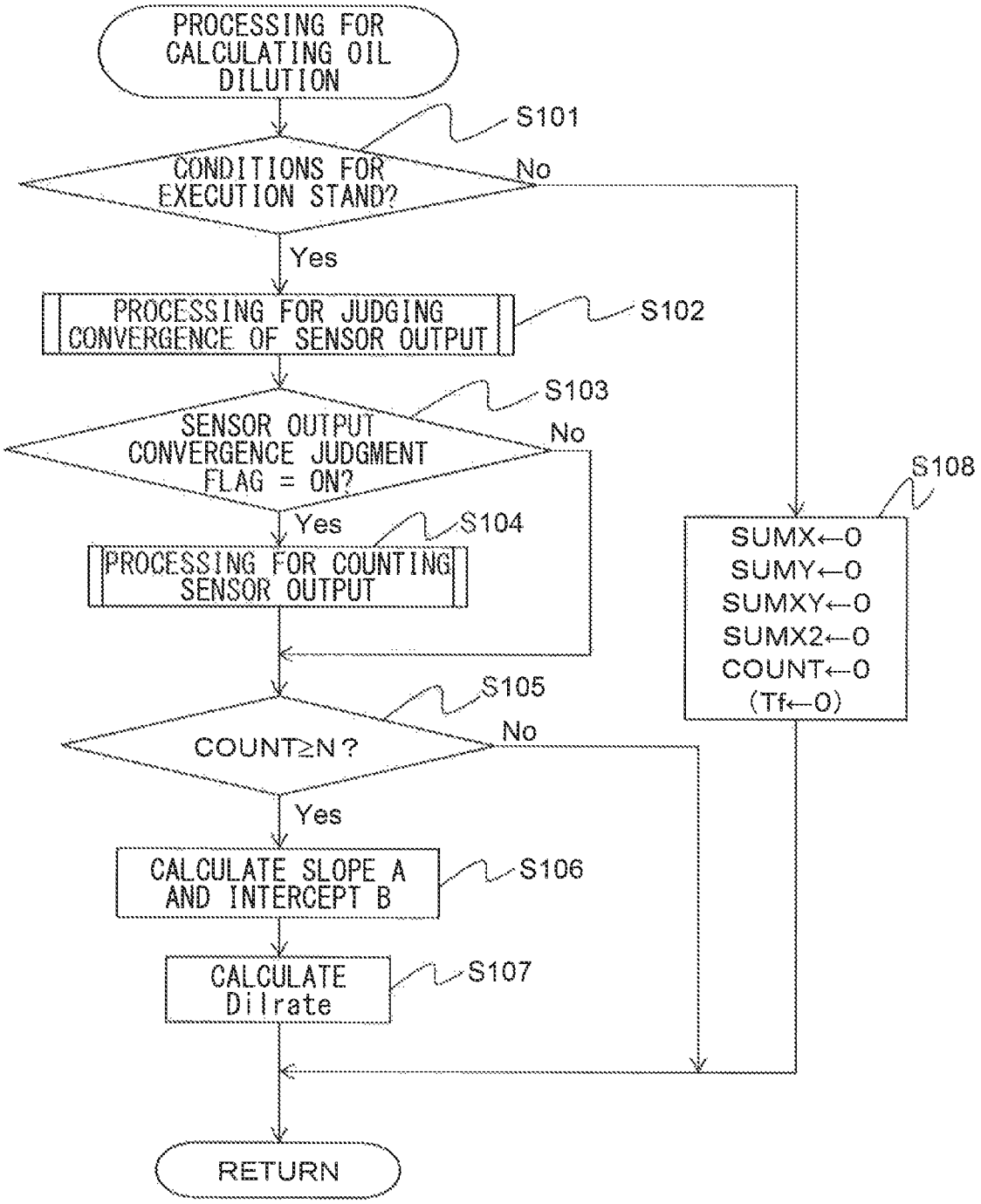
FIG. 8 is a flow chart showing a control routine for processing for calculating the oil dilution rate in a first embodiment of the present invention.

FIG. 8 is a flow chart showing a control routine for processing for calculating the oil dilution rate in the first embodiment of the present invention. The illustrated control routine is performed by interruption at certain time intervals. In the first embodiment, first, at step S101, it is judged if the conditions for execution of processing for calculating the oil dilution rate stand. The case where conditions for execution of the processing for calculating the oil dilution rate stand is, for example, the case where fuel cut control is being performed and the air-fuel ratio sensor 40 or 41 is active. The case where an air-fuel ratio sensor 40 or 41 is active is the case where the temperature of the sensor element of an air-fuel ratio sensor 40 or 41 is a predetermined value or more, for example, the case where the impedance of the sensor element of the air-fuel ratio sensor 40 or 41 is within a predetermined value.

If at step S101 it is judged that the conditions for execution for processing for calculating the oil dilution rate stand, the routine proceeds to step S102. At step S102, the control routine for processing for judging convergence of sensor output of the air-fuel ratio sensor 40 or 41 is executed. This control routine differs between when the upstream air-fuel ratio sensor 40 is used to calculate the oil dilution rate and the downstream side air-fuel ratio sensor 41 is used to calculate the oil dilution rate. Note that, the case where at step S101 it is judged that the conditions for execution of processing for calculating the oil dilution rate do not stand will be explained later.

First, the control routine for judging convergence of the sensor output of the downstream side air-fuel ratio sensor 41 will be explained.

Figure 9:
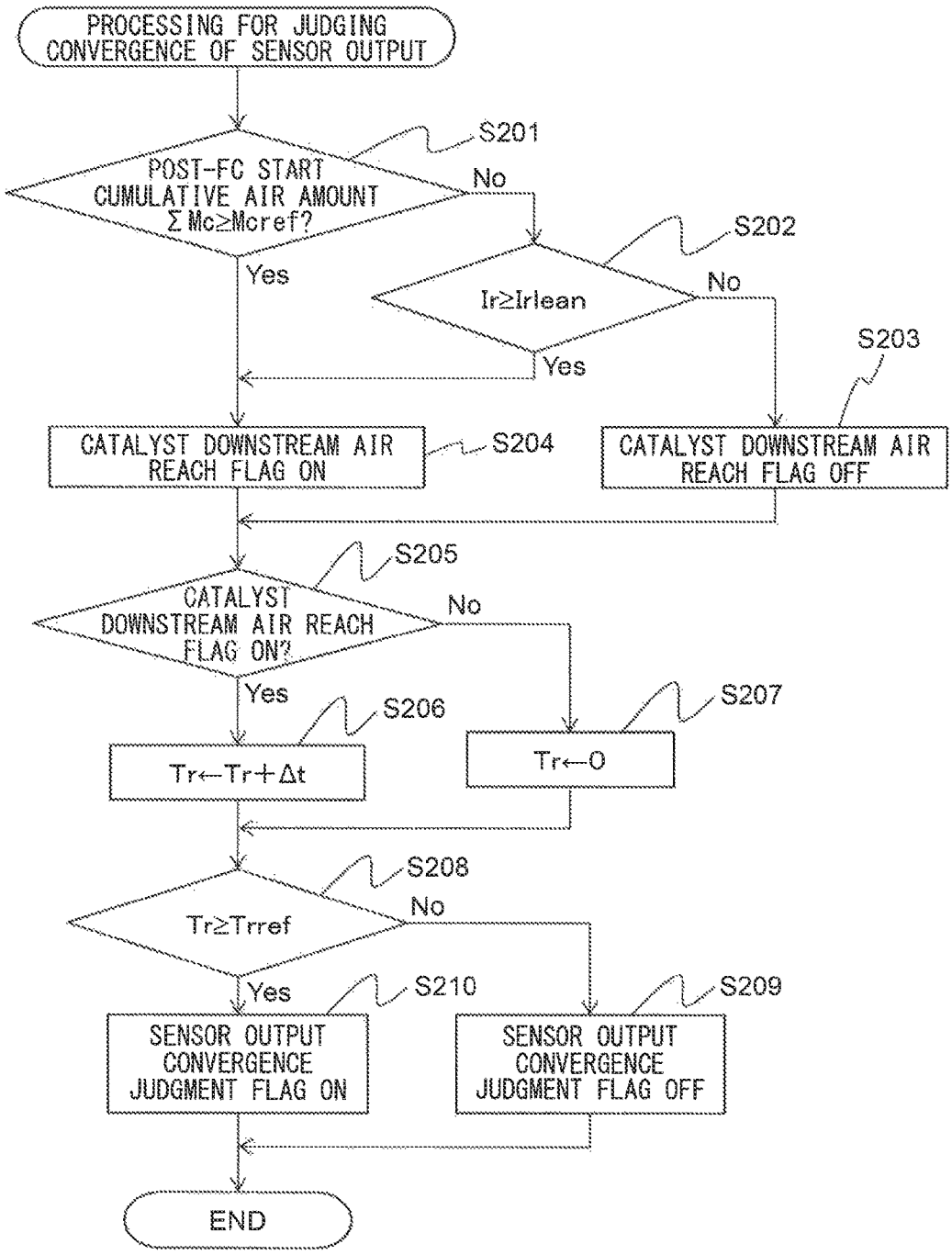
FIG. 9 is a flow chart showing a control routine for processing for judging convergence of sensor output of a downstream side air-fuel ratio sensor in the first embodiment of the present invention.

FIG. 9 is a flow chart showing the control routine for processing for judging convergence of sensor output of the downstream side air-fuel ratio sensor 41 in the first embodiment of the present invention. The calculation of the oil dilution rate which uses the downstream side air-fuel ratio sensor 41 has to be performed after the air reaches the downstream side air-fuel ratio sensor 41 at the downstream side of the upstream side exhaust purification catalyst 20 after the start of fuel cut control and the sensor output of the downstream side air-fuel ratio sensor 41 converges. For this reason, the control routine shown in FIG. 9 can be used to judge that the sensor output of the downstream side air-fuel ratio sensor 41 has converged.

As shown in FIG. 9, first, step S201, it is judged if the cumulative value ΣMc of the amount of intake air (cumulative amount of air) fed to a combustion chamber 5 from when fuel cut control is started is a predetermined reference cumulative amount Mcref or more. The cumulative amount of air is for example calculated based on the output of the air flowmeter 39. In addition, at step S202, it is judged if the output current Ir of the downstream side air-fuel ratio sensor 41 has become a lean judged reference value Irlean larger than zero or more.

If at steps S201 and S202 it is judged that the cumulative amount of air ΣMc after the start of fuel cut control is smaller than the reference cumulative amount Mcref and the output current Ir of the downstream side air-fuel ratio sensor 41 is smaller than the lean judged reference value Irlean, it is considered that the oxygen storage amount of the upstream side exhaust purification catalyst 20 has not reached the maximum storable oxygen amount Cmax. For this reason, in such a case, the routine proceeds to step S203. At step 203, the catalyst downstream air reach flag is turned OFF and the routine proceeds to step S205.

On the other hand, if at step S201 the cumulative amount of air ΣMc after the start of fuel cut control is the reference cumulative amount Mcref or more or if at step S202 it is judged that the output current Ir of the downstream side air-fuel ratio sensor 41 is the lean judged reference value Irlean or more, it is considered that the oxygen storage amount of the upstream side exhaust purification catalyst 20 has reached the maximum storable oxygen amount Cmax. Therefore, after that, the air-fuel ratio of the exhaust gas flowing out from the upstream side exhaust purification catalyst 20 gradually rises. For this reason, in such a case, the routine proceeds to step S204. At step S204, the catalyst downstream air reach flag is turned ON, then the routine proceeds to step S205.

At step S205, it is judged if the catalyst downstream air reach flag is ON. If it is judged that the catalyst downstream air reach flag is ON, the routine proceeds to step S206. At step S206, the elapsed time Tr from when air reaches the downstream side of the upstream side exhaust purification catalyst 20 after the start of fuel cut control is calculated. Specifically, the elapsed time Tr plus a slight time Δt (corresponding to interval of execution of the control routine) is made the new elapsed time Tr. On the other hand, if at step S205 it is judged that the catalyst downstream air reach flag is OFF, it is considered that air has not reached the downstream side of the upstream side exhaust purification catalyst 20, and therefore the routine proceeds to step S207 where the elapsed time Tr is reset and made zero.

Next, at step S208, it is judged if the elapsed time Tr is a predetermined convergence judgment reference time Trref or more. If it is judged that the elapsed time Tr is shorter than the convergence judgment reference time Trref, the routine proceeds to step S209. In this case, it is considered that the output current Ir of the downstream side air-fuel ratio sensor 41 has not converged, and therefore the sensor output convergence judgment flag is set to OFF and, after that, the control routine for processing for judging convergence of sensor output is ended. On the other hand, if it is judged that the elapsed time Tr is the convergence judgment reference time Trref or more, the routine proceeds to step S210. In this case, it is considered that the output current Ir of the downstream side air-fuel ratio sensor 41 has converged, and therefore the sensor output convergence judgment flag is set to ON and, after that, the control routine for the processing for judging convergence of sensor output is ended.

Next, the control routine for judging convergence of sensor output of the upstream side air-fuel ratio sensor 40 will be explained.

Figure 10:
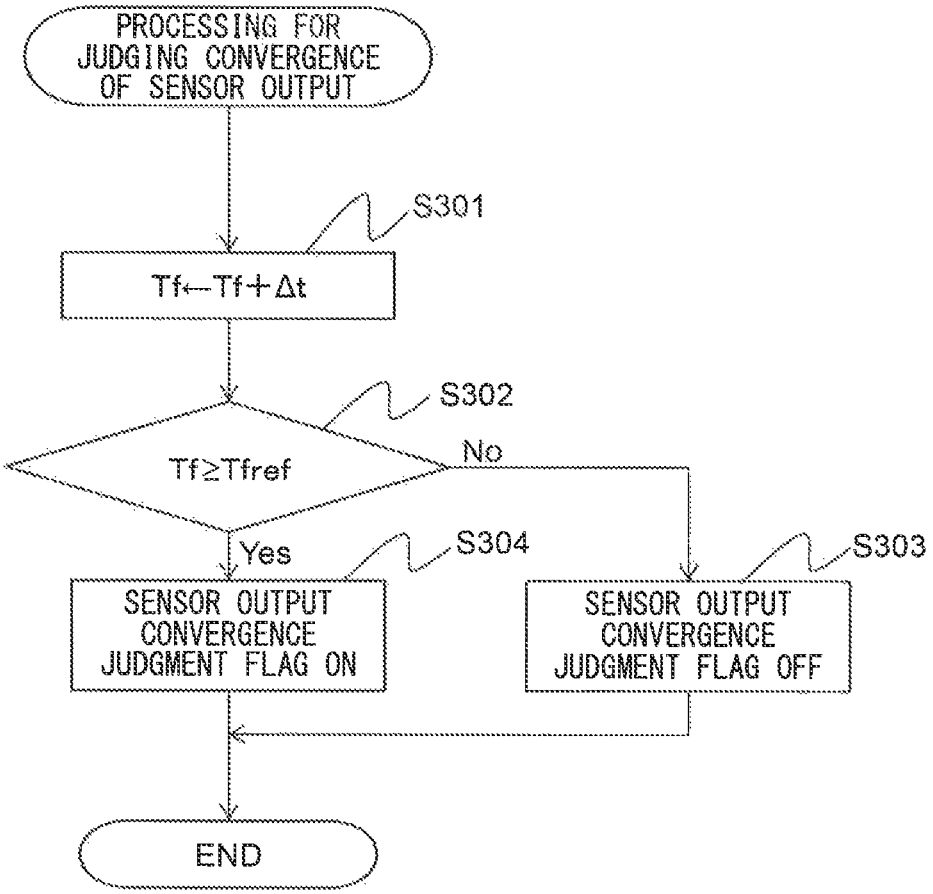
FIG. 10 is a flow chart showing a control routine for processing for judging convergence of sensor output of an upstream side air-fuel ratio sensor in the first embodiment of the present invention.

FIG. 10 is a flow chart showing the control routine for processing for judging convergence of sensor output of the upstream side air-fuel ratio sensor 40 in the first embodiment of the present invention. The calculation of the oil dilution rate using the upstream side air-fuel ratio sensor 40 has to be performed after air reaches the upstream side air-fuel ratio sensor 40 and the sensor output of the upstream side air-fuel ratio sensor 40 converges after the start of fuel cut control. For this reason, the control routine shown in FIG. 10 is used to judge if the sensor output of the upstream side air-fuel ratio sensor 40 has converged.

At the upstream side air-fuel ratio sensor 40 positioned at the upstream side of the upstream side exhaust purification catalyst 20, it is not necessary to judge if the oxygen storage amount of the upstream side exhaust purification catalyst 20 has reached the maximum storable oxygen amount. For this reason, as shown in FIG. 10, first, at step S301, the elapsed time Tf after the start of fuel cut control is calculated. Specifically, the value of the elapsed time Tf plus a slight time Δt (corresponding to interval of execution of the control routine) is made the new elapsed time Tf.

Next, at step S302, it is judged if the elapsed time Tf is a predetermined convergence judgment reference time Tfref or more. If it is judged that the elapsed time Tf is shorter than the convergence judgment reference time Tfref, the routine proceeds to step S303. In this case, it is considered that the output current If of the upstream side air-fuel ratio sensor 40 has not converged, and therefore the sensor output convergence judgment flag is set to OFF and, after that, the control routine for the processing for judging convergence of sensor output is ended. On the other hand, if it is judged that the elapsed time Tf is the convergence judgment reference time Tfref or more, the routine proceeds to step S304. In this case, it is considered that the output current If of the upstream side air-fuel ratio sensor 40 have converged, and therefore the sensor output convergence judgment flag is set to ON and, after that, the control routine for the processing for judging convergence of sensor output is ended. Note that, the convergence judgment reference time Tfref may be the same time as the convergence judgment reference time Trref.

Referring again to FIG. 8, after the processing for judging convergence of sensor output is performed at step S102, the routine proceeds to step S103. At step S103, it is judged if the sensor output convergence judgment flag is ON. If it is judged that the sensor output convergence judgment flag is ON, the routine proceeds to step S104. On the other hand, if it is judged that the sensor output convergence judgment flag is OFF, the routine proceeds to step S105.

Figure 11:
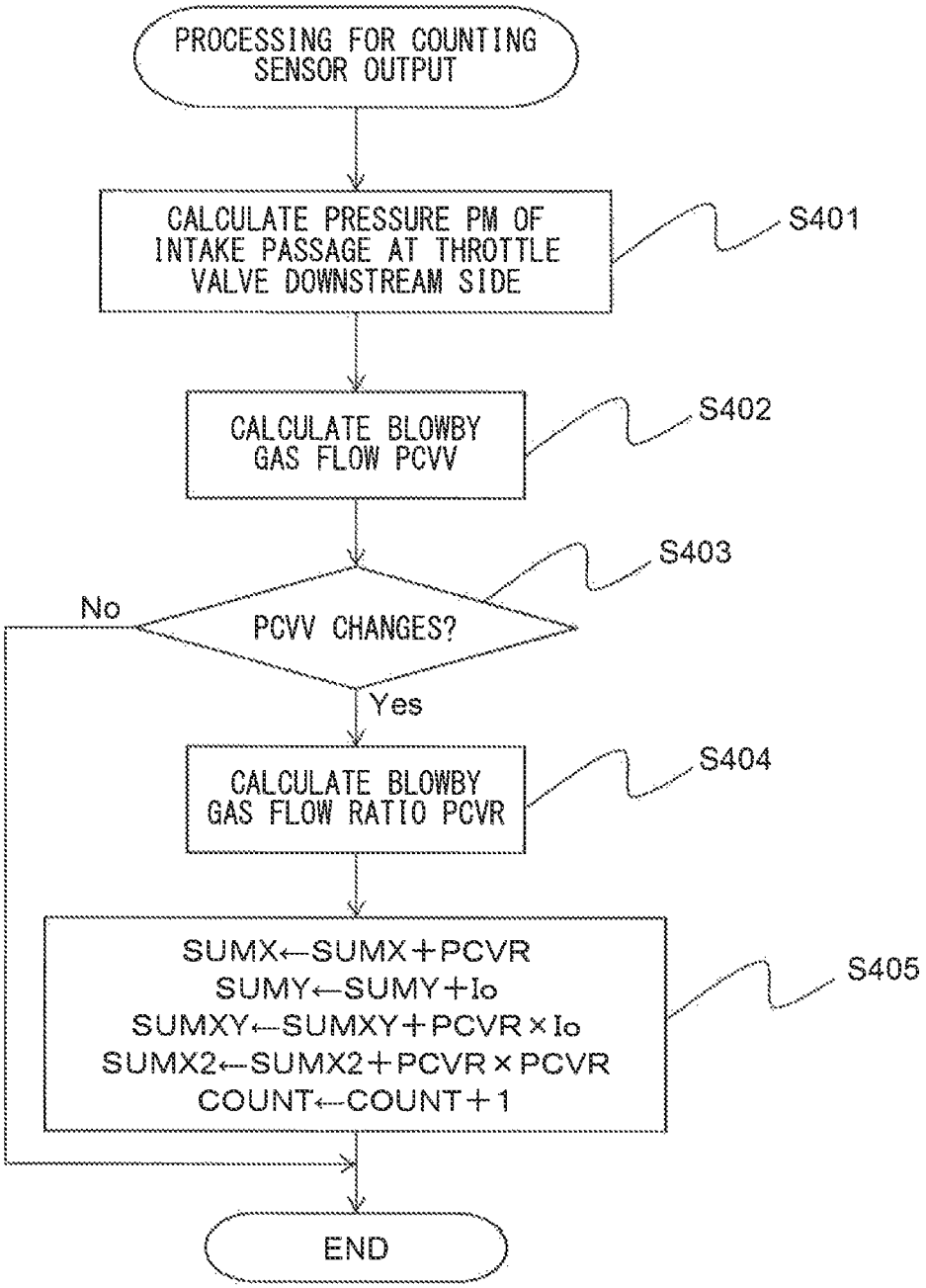
FIG. 11 is a flow chart showing a control routine for processing for counting sensor output in the first embodiment of the present invention.

At step S104, the control routine for the processing for counting the sensor output shown in FIG. 11 is performed. The control routine for the processing for counting the sensor output will be explained below.

FIG. 11 is a flow chart showing the control routine for the processing for counting the sensor output in a first embodiment of the present invention. In this control routine, the blowby gas flow ratio and the output currents of the air-fuel ratio sensor 40 or 41 are acquired, and the values required for calculating the slope and intercept of the first order approximation line showing the relationship between the blowby gas flow ratio and the output current of the air-fuel ratio sensor 40 or 41 are calculated.

As shown in FIG. 11, first, at step S401, a pressure PM at the downstream side of the throttle valve 18 in the intake passage is calculated. The pressure PM, for example, is directly detected by a pressure sensor provided at the downstream side of the throttle valve 18 in the intake passage or is calculated by known model calculations based on the output of an intake air temperature sensor provided at the downstream side of the throttle valve 18, the output of the air flowmeter 39, the opening degree of the throttle valve 18, etc.

Next, at step S402, a map showing the relationship between the pressure PM and a blowby gas flow PCVV is used to calculate the blowby gas flow PCVV based on the pressure PM calculated at step S401. The map is stored in the ROM 34.

Next, at step S403, it is judged if the blowby gas flow PCVV calculated at step S402 has changed from the previously calculated blowby gas flow PCVV. If it is judged that the calculated blowby gas flow PCVV has changed from the previously calculated blowby gas flow PCVV, the routine proceeds to step S404. On the other hand, if it is judged that the calculated blowby gas flow PCVV has not changed from the previously calculated blowby gas flow PCVV, that is, if the calculated blowby gas flow PCVV is the same value as the previously calculated blowby gas flow PCVV, the control routine for processing for counting the sensor output is ended.

Next, at step S404, based on the blowby gas flow PCVV calculated at step S402 and the intake air amount GA taken into the combustion chamber 5 through the throttle valve 18, a blowby gas flow ratio PCVR is calculated by the following equation:

$$PCVR=PCVV/(PCVV+GA)$$

Note that, the intake air amount GA is detected by the air flowmeter 39.

Next, at step S405, a sum SUMX of blowby gas flow ratios PCVR, a sum SUMY of output currents Io of the air-fuel ratio sensor 40 or 41, a sum of products SUMXY of the blowby gas flow ratio PCVR multiplied with the output current Io (below referred to as the "sum of products"), a sum of squares SUMX2 of the blowby gas flow ratio PCVR (below referred to as the "sum of squares"), and the number of times COUNT by which the control routine for processing for counting the sensor output is executed (below, referred to as "number of times of execution") are calculated.

Specifically, at step S405, the previously calculated sum SUMX of the blowby gas flow ratios PCVR plus the newly calculated blowby gas flow ratio PCVR is made the new sum SUMX of the blowby gas flow ratios PCVR. Further, the previously calculated sum SUMY of the output currents Io plus the newly detected output current Io is made the new sum SUMY of the output currents Io. Furthermore, the previously calculated sum of products SUMXY plus the product of the newly calculated blowby gas flow PCVV multiplied with the newly detected output current Io is made the new sum of products SUMXY. Further, the previously calculated sum of squares SUMX2 plus the square of the newly calculated blowby gas flow ratio PCVR is made the new sum of squares SUMX2. Furthermore, the previously calculated number of times of execution COUNT plus 1 is made the new number of times of execution COUNT. After that, the control routine for processing for counting the sensor output is ended.

Note that, at step S403 and step S404, instead of the blowby gas flow PCVV calculated at step S402, the blowby gas flow directly detected by a blowby gas flow meter provided at the downstream side from the PCV valve 26 in the blowby gas passage 25 (intake runner 13 side) may be used. In this case, step S401 and step S402 in FIG. 11 are omitted.

Referring again to FIG. 8, after the processing for counting the sensor output is executed at step S104, the routine proceeds to step S105. At step S105, it is judged if the number of times COUNT by which the control routine for processing for counting the sensor output is executed is a predetermined value N or more. The predetermined value N is any number of 2 or more. If it is judged if the number of times COUNT is the predetermined value N or more, the routine proceeds to step S106. On the other hand, when it is judged that the number of times of execution COUNT is less than the predetermined value N, the control routine for calculating the oil dilution rate is ended.

At step S106, based on the values obtained at step S104, the slope A and intercept B of the first order approximation line showing the relationship between the blowby gas flow ratio and the output current of the air-fuel ratio sensor 40 or 41 are calculated by the least square method by the following equations:

$$A=(\text{COUNT}\times\text{SUMXY}-\text{SUMX}\times\text{SUMY})/(\text{COUNT}\times\text{SUMX2}-\text{SUMX}\times\text{SUMX})$$

$$B=(\text{SUMX2}\times\text{SUMY}-\text{SUMXY}\times\text{SUMX})/(\text{COUNT}\times\text{SUMX2}-\text{SUMX}\times\text{SUMX})$$

Next, at step S107, based on the slope A and intercept B calculated at step S106, the oil dilution rate Dilrate is calculated by the following equation (above-mentioned equation (9)).

$$\text{Dilrate}=-0.8\times\text{Ln}(1/0.8)/(K\times L)\times A/B$$

Note that, as explained above, the concentration K of oxygen consumed per concentration of fuel in the blowby gas and the concentration L of fuel in the blowby gas per oil dilution rate are values known in advance by experiments.

After step S107, the control routine for processing for calculating the oil dilution rate is ended.

If at step S101 it is judged that the conditions for execution of processing for calculating the oil dilution rate do not stand, for example, if fuel cut control is not under way or if the air-fuel ratio sensor 40 or 41 is not active, the routine proceeds to step S108. At step S108, all of the values obtained by the processing for counting the sensor output of step S104 are reset and made zero. In addition to this, when using the upstream side air-fuel ratio sensor 40 to calculate the oil dilution rate, the elapsed time Tf after the start of fuel cut control used in the processing for judging convergence of sensor output shown in FIG. 9 is reset and made zero.

Therefore, even if processing for counting the sensor output of step S104 is executed during fuel cut control, if the fuel cut control is ended before the number of times of execution COUNT becomes N or more, at step S109, the value obtained by the processing for counting the sensor output is reset and made zero. As a result, in the present embodiment, the blowby gas flow ratio and the output current of the air-fuel ratio sensor 40 or 41 are not calculated over a plurality of cycles of fuel cut control, but are calculated at a plurality of points of time in a single cycle of fuel cut control.

If the processing for calculating the oil dilution rate is performed over a plurality of cycles of fuel cut control, sometimes the oil dilution rate ends up changing during the processing for calculating the oil dilution. In this case, only naturally, it is not possible to accurately calculate the oil dilution rate. However, in the present embodiment, the oil dilution rate is calculated based on the blowby gas flow ratios and output currents of the air-fuel ratio sensor 40 or 41 acquired at a plurality of points of time in single cycle of fuel cut control, and therefore it is possible to avoid an inaccurate oil dilution rate from being calculated due to the oil dilution rate ending up changing in the processing for calculating the oil dilution rate, and in turn it is possible to raise the precision of calculation of the oil dilution rate.

<Second Embodiment>

Next, referring to FIG. 12 to FIG. 14, the second embodiment of the present invention will be explained. As will be understood from FIG. 7, to accurately calculate the slope and intercept of the first order approximation line showing the relationship between the blowby gas flow ratio and the output current of the air-fuel ratio sensor 40 or 41, it is necessary that the blowby gas flow ratios acquired during fuel cut control are dispersed to a certain extent. For this reason, if the amount of change of the blowby gas flow ratios acquired at a plurality of points of time is small, for example, if the engine speed does not fluctuate that much during fuel cut control, the oil dilution rate calculation system is liable to be unable to accurately calculate the oil dilution rate.

Therefore, the oil dilution rate calculation system of the second embodiment is configured to calculate the amount of change of the blowby gas flow ratios acquired at a plurality of points of time, and not to calculate the oil dilution rate when the calculated amount of change is less than a predetermined value. As a result, according to the second embodiment, it is possible to avoid an inaccurate oil dilution rate being calculated due to the amount of change of the blowby gas flow ratios acquired at a plurality of points of time being small, and in turn it is possible to raise the precision of calculation of the oil dilution rate. Note that, the "amount of change of the blowby gas flow ratio" is, for example, the coefficient of variation of the blowby gas flow ratio showing the relative variation of the values of the blowby gas flow ratios acquired at a plurality of points of time.

Figure 12:
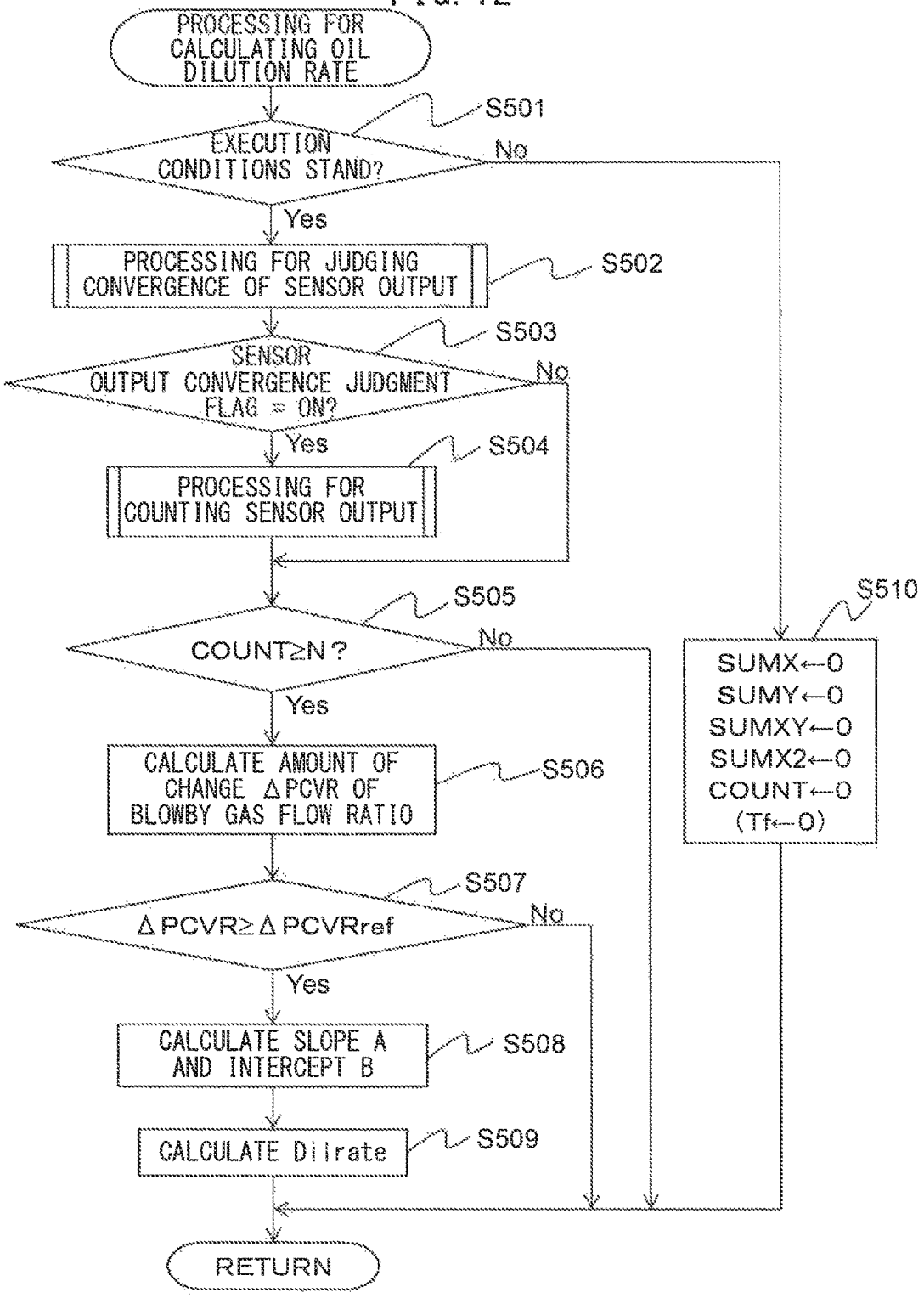
FIG. 12 is a flow chart showing a control routine for processing for calculating the oil dilution rate in a second embodiment of the present invention.

FIG. 12 is a flow chart showing a control routine of processing for calculating the oil dilution rate in the second embodiment of the present invention. The illustrated control routine is performed by interruption at certain time intervals.

Step S501 to step S505 and step S508 to step S510 in FIG. 12 are similar to step S101 to step S105 and step S106 to step S108 in FIG. 8, and therefore explanations will be omitted.

At step S506, the amount of change ΔPCVR of the blowby gas flow ratio is calculated. The parameter of the amount of change ΔPCVR is, for example, the coefficient of variation PCVRCV of the blowby gas flow ratio.

The coefficient of variation PCVRCV of the blowby gas flow ratio will be calculated based on the value obtained at step S504 by the following equation:

$$\text{PCVRCV}=\text{SQRT}\{(\text{SUMX2}-\text{SUMX}\times\text{SUMX}/\text{COUNT})/(\text{COUNT}-1)\}(\text{SUMX}/\text{COUNT})$$

Note that, SQRT indicates the square root.

Next, at step S507, it is judged if the amount of change ΔPCVR of the blowby gas flow ratio calculated at step S506 is the reference amount of change ΔPCVRref of the predetermined blowby gas flow ratio or more.

If at step S507 it is judged that the amount of change ΔPCVR is ΔPCVRref or more, the routine proceeds to step S508. On the other hand, if at step S507 it is judged that the amount of change ΔPCVR is less than the reference amount of change ΔPCVRref, accurate calculation of the oil dilution rate is difficult, and therefore control routine for processing for calculating the oil dilution rate is ended.

Note that, as the parameter of the amount of change ΔPCVR at step S506, the difference PCVRD of the maximum value and the minimum value of the blowby gas flow ratios may be used. In this case, at step S504, instead of the processing for counting the sensor output shown in FIG. 11, the control routine for processing for counting the sensor output shown in FIG. 13 is executed.

Figure 13:
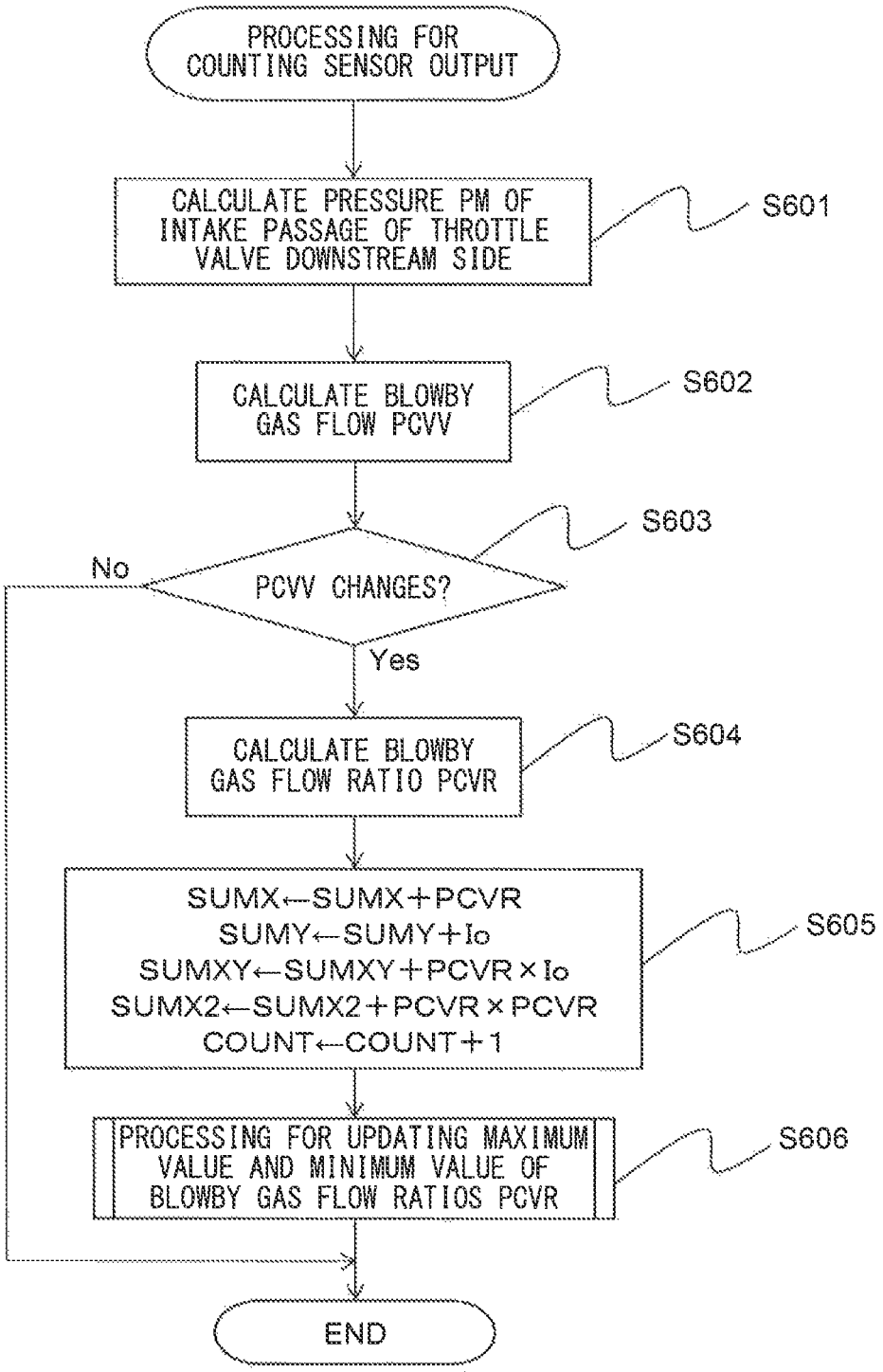
FIG. 13 is a flow chart showing a control routine for processing for counting sensor output in the second embodiment of the present invention when a difference between a maximum value and minimum value of a blowby gas flow ratio is used as a parameter of an amount of change of the blowby gas flow ratio.

FIG. 13 is a flow chart showing the control routine for processing for counting the sensor output in the second embodiment when the difference PCVRD of the maximum value and the minimum value of the blowby gas flow ratios is used as the parameter of the amount of change ΔPCVR. Note that, steps S601 to S605 in FIG. 13 are similar to steps S401 to S405 in FIG. 11, and therefore explanations will be omitted. In the control routine for processing for counting the sensor output shown in FIG. 13, after step S605, the routine proceeds to step S606. At step S606, the control routine for processing for updating the maximum value and minimum value of the blowby gas flow ratios PCVR shown in FIG. 14 is executed.

Figure 14:
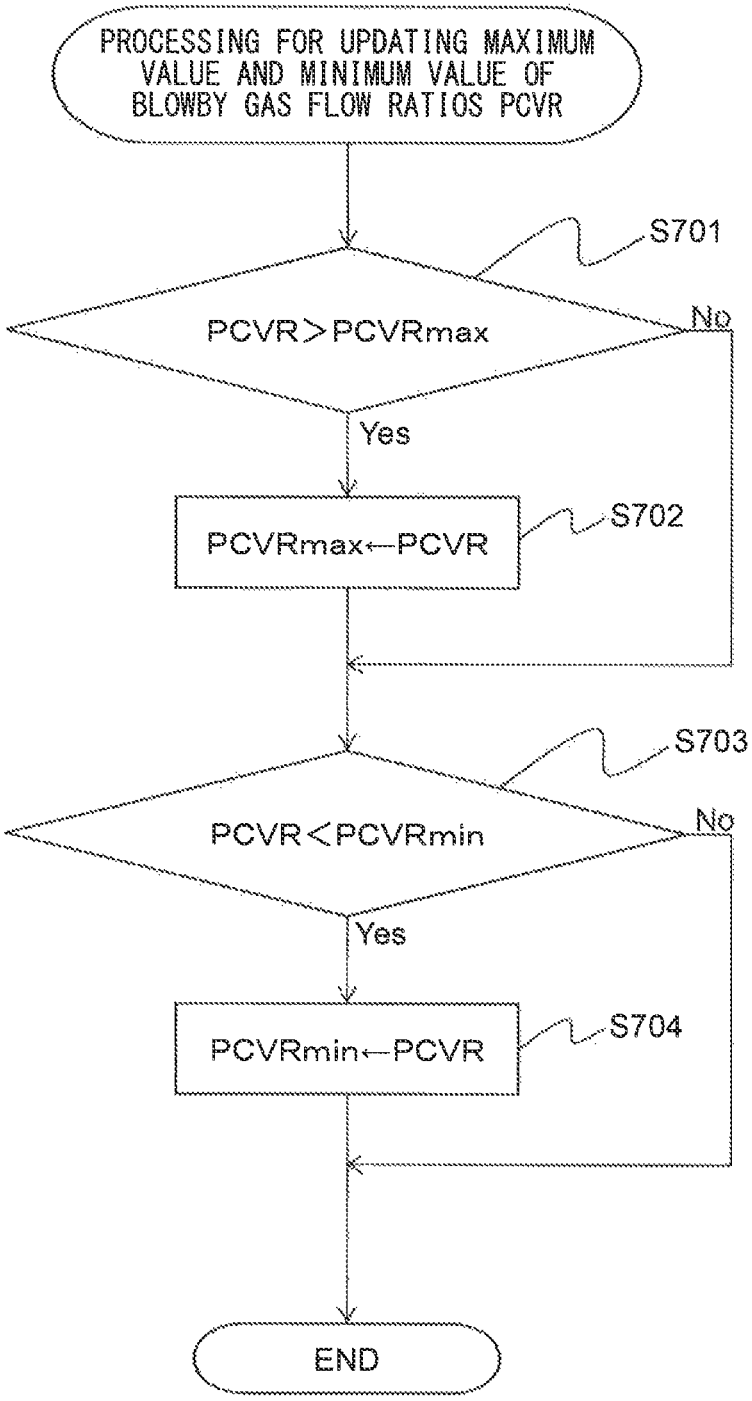
FIG. 14 is a flow chart showing a control routine for processing for updating maximum values and minimum values of the blowby gas flow ratio.

FIG. 14 is a flow chart showing the control routine for processing for updating the maximum value and minimum value of the blowby gas flow ratios PCVR. In this control routine, the blowby gas flow ratio PCVR calculated at step S604 in FIG. 13 is compared with the maximum value PCVRmax and the minimum value PCVRmin of the blowby gas flow ratios calculated at the points of time before that, and the maximum value PCVRmax and the minimum value PCVRmin of the blowby gas flow ratios are updated.

As shown in FIG. 14, first, step S701, it is judged if the blowby gas flow ratio PCVR calculated at step S604 at FIG. 13 is larger than the maximum value PCVRmax of the blowby gas flow ratios calculated at points of time before that. If it is judged that the blowby gas flow ratio PCVR is larger than the maximum value PCVRmax of the blowby gas flow ratios, the routine proceeds to step S702. At step S702, the blowby gas flow ratio PCVR is made the new maximum value PCVRmax of the blowby gas flow ratios, after that, the routine proceeds to step S703. On the other hand, if it is judged that the blowby gas flow ratio PCVR is the maximum value PCVRmax of the blowby gas flow ratios or less, the routine proceeds to step S703 without updating the maximum value PCVRmax of the blowby gas flow ratios.

At step S703, it is judged if the blowby gas flow ratio PCVR calculated at step S604 in FIG. 13 is smaller than the minimum value PCVRmin of the blowby gas flow ratios calculated at points of time before that. If it is judged that the blowby gas flow ratio PCVR is smaller than the minimum value PCVRmin of the blowby gas flow ratios, the routine proceeds to step S704. At step S704, the blowby gas flow ratio PCVR is made the new minimum value PCVRmin of the blowby gas flow ratios, then the control routine for processing for updating the maximum value and minimum value of the blowby gas flow ratios PCVR is ended. On the other hand, when it is judged that the blowby gas flow ratio PCVR is the minimum value PCVRmin of the blowby gas flow ratios or more, the control routine for processing for updating the maximum value and minimum value of the blowby gas flow ratios PCVR is ended without updating the minimum value PCVRmin of the blowby gas flow ratios.

Referring again to FIG. 13, processing for updating the maximum value and the minimum value of the blowby gas flow ratios PCVR is executed at step S606, then the control routine for processing for counting the sensor output is ended.

<Third Embodiment>

Next, referring to FIG. 15 to FIG. 17, a third embodiment of the present invention will be explained. The gain of the air-fuel ratio sensor 40 or 41 fluctuates depending on the temperature of the sensor element, atmospheric pressure, etc. For this reason, if the temperature of the sensor element, atmospheric pressure, etc. fluctuate while the blowby gas flow ratio and the output current of the air-fuel ratio sensor 40 or 41 are being acquired, the oil dilution rate calculation system is liable to be unable to accurately calculate the oil dilution rate.

Therefore, the oil dilution rate calculation system of the third embodiment is configured to acquire variation factors, for example, the values of the impedance of the sensor element and atmospheric pressure, which cause fluctuation of the output currents of the air-fuel ratio sensor 40 or 41, at a plurality of points of time when the blowby gas flow ratio and output current of the air-fuel ratio sensor 40 or 41 are acquired, calculate the amount of change of the values of the acquired variation factors, and not to calculate the oil dilution rate when the calculated amount of change is a predetermined value or more. As a result, according to the third embodiment, while the blowby gas flow ratio and the output current of the air-fuel ratio sensor 40 or 41 are being acquired, it is possible to avoid an inaccurate oil dilution rate being calculated due to fluctuation of the variation factors causing fluctuation of the output current of the air-fuel ratio sensor 40 or 41, and in turn it is possible to raise the precision of calculation of the oil dilution rate.

Figure 15:
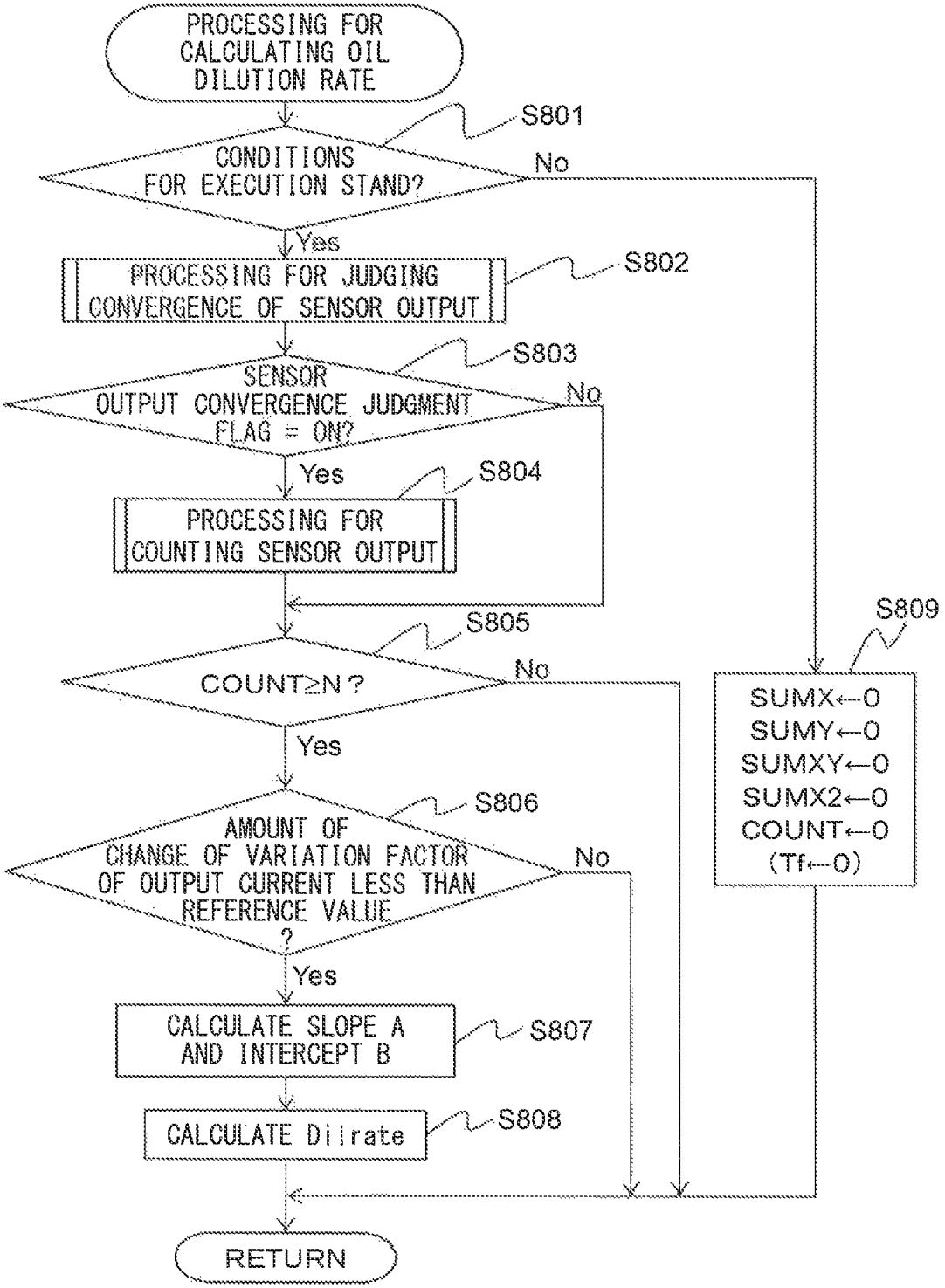
FIG. 15 is a flow chart showing a control routine for processing for calculating the oil dilution rate in a third embodiment of the present invention.

FIG. 15 is a flow chart showing the control routine of processing for calculating the oil dilution rate in a third embodiment of the present invention. The illustrated control routine is performed by interruption at certain time intervals.

Step S801 to step S803 and step S805 and step S807 to step S809 in FIG. 15 are similar to step S101 to step S103, step S105*a* and step S106 to step S108 in FIG. 8, and therefore explanations will be omitted.

Figure 16:
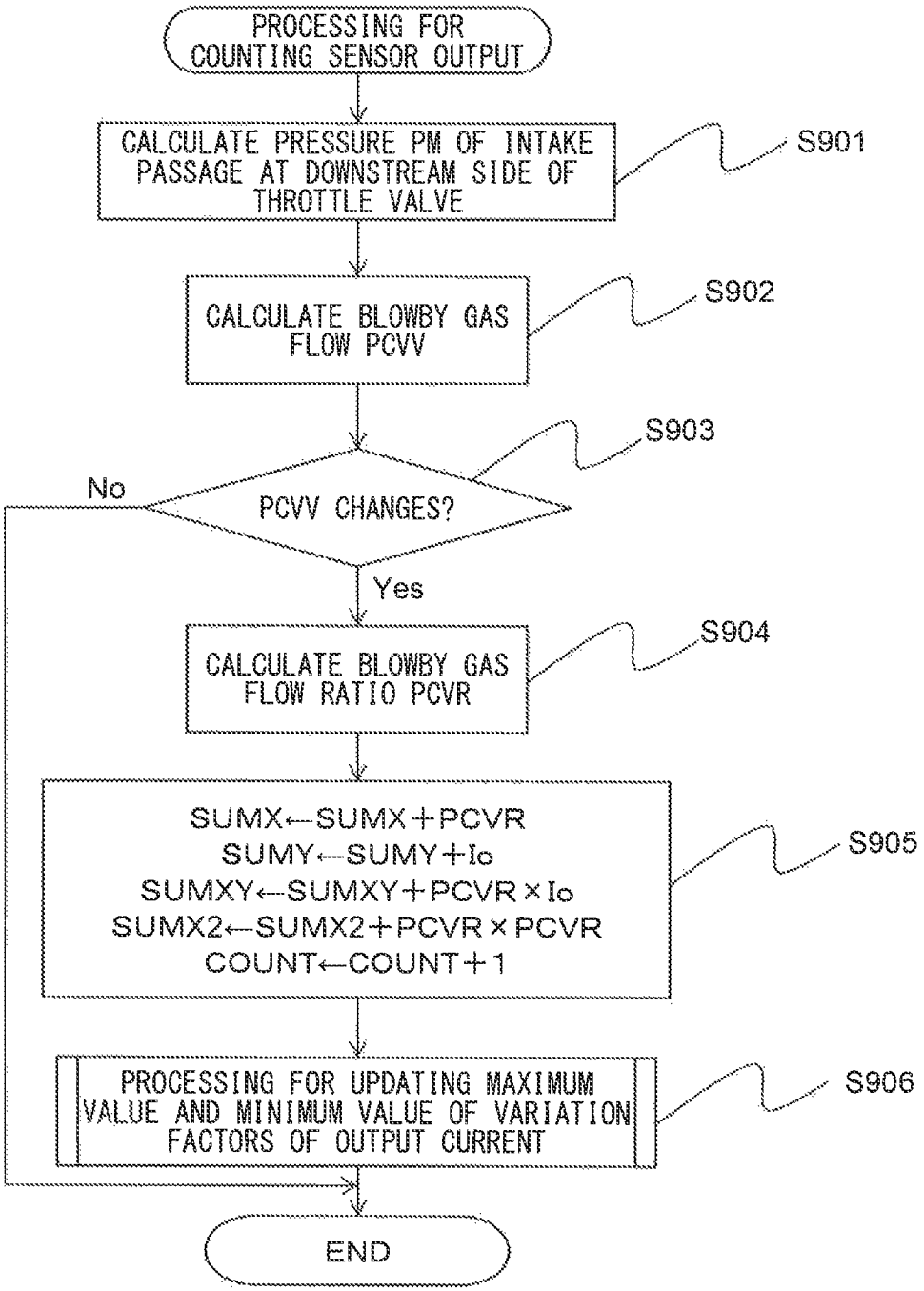
FIG. 16 is a flow chart showing a control routine for processing for counting sensor output in the third embodiment of the present invention.

At step S804, the control routine for processing for counting the sensor output shown in FIG. 16 is executed. FIG. 16 is a flow chart showing the control routine for processing for counting the sensor output in the third embodiment. Note that, steps S901 to S905 in FIG. 16 are similar to steps S401 to S405 in FIG. 11, and therefore explanations will be omitted.

In the control routine for processing for counting the sensor output shown in FIG. 16, after step S905, the routine proceeds to step S906. At step S906, the control routine for processing for updating the maximum values and minimum values of the output current variation factors shown in FIG. 17 is executed.

Figure 17:
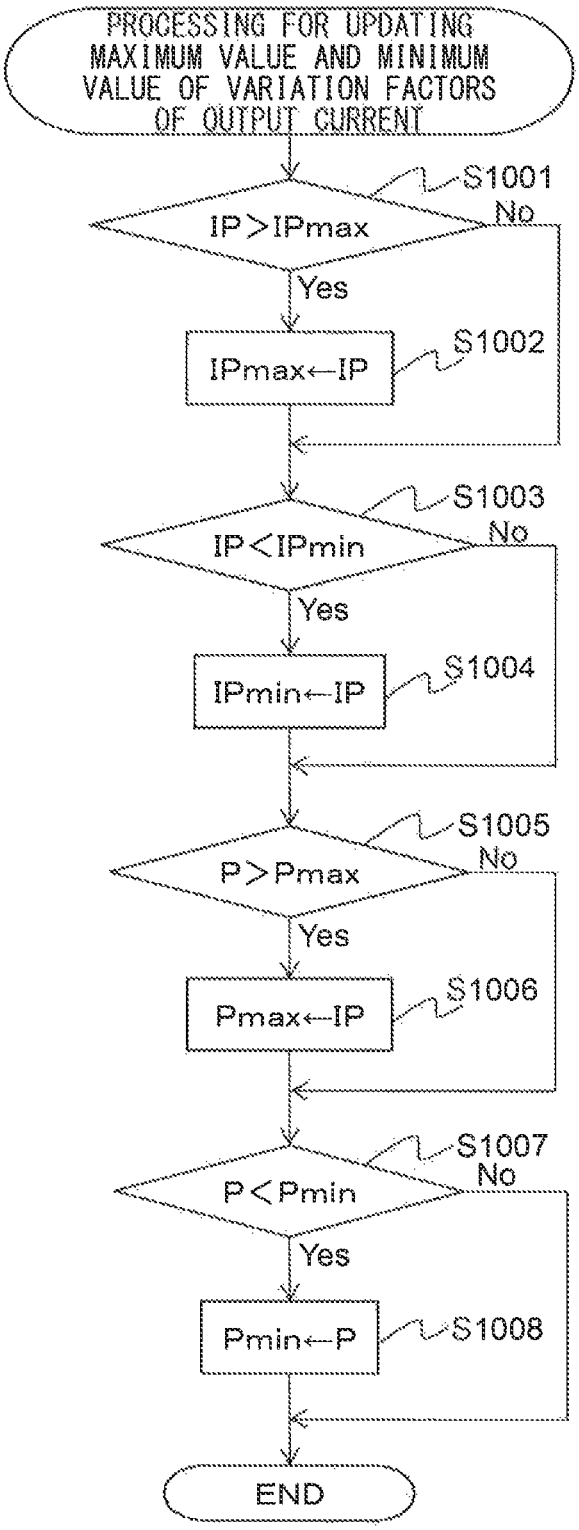
FIG. 17 is a flow chart showing a control routine for processing for updating maximum values and minimum values of output current variation factors.

FIG. 17 is a flow chart showing the control routine for processing for updating the maximum values and minimum values of the output current variation factors. In this control routine, the variation factors of the output current, that is, sensor element impedance IP and atmospheric pressure P, are acquired, the acquired sensor element impedance IP and atmospheric pressure P are compared with the maximum value IPmax and the minimum value IPmin of the sensor element impedances and the maximum value Pmax and the minimum value Pmin of the atmospheric pressures calculated at points of time before that, and the maximum value IPmax and the minimum value IPmin of the sensor element impedances and the maximum value Pmax and the minimum value Pmin of the atmospheric pressures are updated.

As shown in FIG. 17, first, at step S1001, the sensor element impedance IP is acquired, and it is judged if the acquired sensor element impedance IP is larger than the maximum value IPmax of the sensor element impedances obtained at points of time before that. If it is judged that the sensor element impedance IP is larger than the maximum value IPmax of the sensor element impedances, the routine proceeds to step S1002. At step S1002, the sensor element impedance IP is made the new maximum value IPmax of the sensor element impedances, and after that, the routine proceeds to step S1003. On the other hand, if it is judged that the sensor element impedance IP is the maximum value IPmax of the sensor element impedances or less, the routine proceeds to step S1003 without updating the maximum value IPmax of the sensor element impedances.

At step S1003, it is judged if the acquired sensor element impedance IP is smaller than the minimum value IPmin of the sensor element impedances acquired at points of time before that. If it is judged that the sensor element impedance IP is smaller than the minimum value IPmin of the sensor element impedances, the routine proceeds to step S1004. At step S1004, the sensor element impedance IP is made the new minimum value IPmin of the sensor element impedances, and after that, the routine proceeds to step S1005. On the other hand, if it is judged that the sensor element impedance IP is the minimum value IPmin of the sensor element impedances or more, the routine proceeds to step S1005 without updating the minimum value IPmin of the sensor element impedances.

At step S1005, the atmospheric pressure P is acquired and it is judged if the acquired atmospheric pressure P is larger than the maximum value Pmax of the atmospheric pressures acquired at points of time before that. If it is judged that the atmospheric pressure P is larger than the maximum value Pmax of the atmospheric pressures, the routine proceeds to step S1006. At step S1006, the atmospheric pressure P is made the new maximum value Pmax of the atmospheric pressures, and after that, the routine proceeds to step S1007. On the other hand, if it is judged that the atmospheric pressure P is the maximum value Pmax of the atmospheric pressures or less, the routine proceeds to step S1007 without updating the maximum value Pmax of the atmospheric pressures.

At step S1007, it is judged if the acquired atmospheric pressure P is smaller than the minimum value Pmin of the atmospheric pressures acquired at points of time before that. If it is judged that the atmospheric pressure P is smaller than the minimum value Pmin of the atmospheric pressures, the routine proceeds to step S1008. At step S1008, the atmospheric pressure P is made the new minimum value Pmin of the atmospheric pressures, and after that, the control routine for processing for updating the maximum value and minimum value of the output current variation factors is ended. On the other hand, if it is judged that the atmospheric pressure P is the minimum value Pmin of the atmospheric pressures or more, the control routine for processing for updating the maximum value and minimum value of the output current variation factors is ended without updating the minimum value Pmin of the atmospheric pressures.

Referring again to FIG. 16, at step S906, the processing for updating the maximum value and the minimum value of the output current variation factors is executed, then control routine for processing for counting the sensor output is ended.

Referring again to FIG. 15, at step S806, it is judged if the amount of change of the output current variation factor is less than a predetermined reference amount of change of the output current variation factor. Specifically, for example, based on the maximum value IPmax and the minimum value IPmin of the sensor element impedances and the maximum value Pmax and the minimum value Pmin of the atmospheric pressures obtained at step S804, it is judged if the difference between the maximum value IPmax and the minimum value IPmin of the sensor element impedances is less than the reference amount of change of the sensor element impedance and the difference between the maximum value Pmax and the minimum value Pmin of the atmospheric pressures is less than the reference amount of change of the atmospheric pressure. Alternatively, it may be judged if the difference between the maximum value IPmax and the minimum value IPmin of the sensor element impedances multiplied with the difference between the maximum value Pmax and the minimum value Pmin of the atmospheric pressures is less than a reference value.

If it is judged at step S806 that the amount of change of the output current variation factor is less than the predetermined reference amount of change of the output current variation factor, the routine proceeds to step S807. On the other hand, if it is judged that step S806 that the amount of change of the output current variation factor is the predetermined reference amount of change of the output current variation factor or more, accurate calculation of the oil dilution rate is difficult, and therefore the control routine for processing for calculating the oil dilution rate is ended.

Note that, in all of the above embodiments, the blowby gas flow ratio and the output current of the air-fuel ratio sensor 40 or 41 may also be calculated not at a plurality of points of time in single cycle of fuel cut control, but at a plurality of points of time at a plurality of cycles of fuel cut control. In this case, the value obtained by the processing for counting the sensor output is reset and made zero after the end of the calculation of the oil dilution rate instead of being reset and made zero when it is judged that the conditions for execution of processing for calculating the oil dilution rate does not stand.

Further, if processing for calculating the oil dilution rate is performed over a plurality of cycles of fuel cut control in such a way, the oil dilution rate may also be calculated only when the cumulative amount of air in the plurality of cycles of fuel cut control is a predetermined value or less. If the cumulative amount of air in the plurality of cycles of fuel cut control is a predetermined value or less, it is expected that there will be little change in the amount of oil dilution rate in the plurality of cycles of fuel cut control. Therefore, by setting the above condition, it is possible to raise the precision of calculation of the oil dilution rate when processing for calculating the oil dilution rate is performed over a plurality of cycles of fuel cut control.

REFERENCE SIGNS LIST

1. engine body
5. combustion chamber
7. intake port
9. exhaust port
13. intake runner
14. surge tank
18. throttle valve
19. exhaust manifold
20. upstream side exhaust purification catalyst
24. downstream side exhaust purification catalyst
25. blowby gas passage
26. PCV valve
31. ECU
40. upstream side air-fuel ratio sensor
41. downstream side air-fuel ratio sensor

The invention claimed is:

1. An oil dilution rate calculation system of an internal combustion engine, wherein the internal combustion engine has an intake passage in which a throttle valve is arranged and which leads an air-fuel mixture containing air and fuel to a combustion chamber, an exhaust passage discharging exhaust gas produced by combustion of the air-fuel mixture in the combustion chamber, a blowby gas passage returning blowby gas in a crankcase to the downstream side of the throttle valve in the intake passage, and an air-fuel ratio sensor provided in the exhaust passage and detecting an air-fuel ratio of the exhaust gas flowing through the exhaust passage, and the oil dilution rate calculation system is configured to acquire a blowby gas flow ratio showing the ratio of the flow of blowby gas to the flow of gas to the combustion chamber and an output current of the air-fuel ratio sensor during fuel cut control in which the internal combustion engine stops the feed of fuel to the combustion chamber and at a plurality of points of time of different flows of blowby gas passing through the blowby gas passage and flowing to the downstream side of the throttle valve in the intake passage, and calculate an oil dilution rate based on the blowby gas flow ratio and output current, and the plurality of points of time are a plurality of points of time at a single cycle of fuel cut control.

2. The oil dilution rate calculation system of an internal combustion engine according to claim 1, wherein the oil dilution rate calculation system is configured to calculate the amount of change of the blowby gas flow ratios acquired at the plurality of points of time, and not calculate the oil dilution rate when the amount of change is less than a predetermined value.

3. The oil dilution rate calculation system of an internal combustion engine according to claim 1, wherein the oil dilution rate calculation system is configured to acquire values of a variation factor causing the output current of the air-fuel ratio sensor to fluctuate, other than the air-fuel ratio of the exhaust gas, at the plurality of points of time, calculate an amount of change of the values of the variation factor, and not calculate the oil dilution rate when the amount of change is a predetermined value or more.

* * * * *